US006953237B2

(12) United States Patent
Otsuki

(10) Patent No.: US 6,953,237 B2
(45) Date of Patent: Oct. 11, 2005

(54) PRINTING UP TO EDGE OF PRINTING PAPER WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 10/644,960

(22) Filed: Aug. 21, 2003

(65) Prior Publication Data

US 2004/0212658 A1 Oct. 28, 2004

(51) Int. Cl.[7] ..... B41J 2/205
(52) U.S. Cl. ..... 347/41; 347/12; 347/40
(58) Field of Search ..... 347/41, 12, 40, 347/16, 104; 400/26, 608, 703, 706

(56) References Cited

U.S. PATENT DOCUMENTS 6,808,259 B2 * 10/2004 Rasmussen et al. ..... 347/104

FOREIGN PATENT DOCUMENTS

JP 2002-103584 4/2002

* cited by examiner

*Primary Examiner*—Lamson Nguyen

(57) ABSTRACT

Using a printer having a recessed portion, printing up to the edge of printing paper is performed without depositing ink drops on the platen. Printing paper P is advanced by upstream paper feed rollers 25*a*, 25*b*, and when its leading edge Pf reaches the opening of a downstream recessed portion 26*r*, printing is initiated using nozzles #1–#3. Since printing commences with leading edge Pf situated upstream from nozzle #1, even if there is some degree of error in paper feed, the image can be printed up to the edge of leading edge portion Pf. Subsequently, printing of the midsectional portion of the printing medium is performed with nozzles #1–#13. During both printing of the leading edge portion of the printing paper using nozzles #1–#3 and printing of the midsectional portion of the printing paper using nozzles #1–#13, printing is carried out in units of a band of predetermined width in the printing paper feed direction. Thus, when transitioning from printing of the leading edge portion to printing of the midsectional portion, printing can be switched efficiently in band units.

19 Claims, 24 Drawing Sheets

Fig.14

| Main scan line number \ Pass number | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ⋮ | | | | | ⋮ | | | | | | | | | | | |
| 67 | | | #6 | | | | | #2 | | | | | | | | |
| 66 | | | | #6 | #3 | | | | | | | | | | | |
| 65 | #7 | | | | | #3 | | | | | | | | | | |
| 64 | | #7 | | | | | #3 | | | | | | | | | |
| 63 | | | #7 | | | | | #3 | | | | | | | | |
| 62 | | | | #7 | #4 | | | | | | | | | | | |
| 61 | #8 | | | | | #4 | | | | | | | | | | |
| 60 | | #8 | | | | | #4 | | | | | | | | | |
| 59 | | | #8 | | | | | #4 | | | | | | | | |
| 58 | | | | #8 | #5 | | | | * | | | | | | | |
| 57 | #9 | | | | | #5 | | | | * | | | | | | |
| 56 | | #9 | | | | | #5 | | | | * | | | | | |
| 55 | | | #9 | | | | | #5 | | | | * | | | | |
| 54 | | | | #9 | #6 | | | | * | | | | | | | |
| 53 | #10 | | | | | #6 | | | | * | | | | | | |
| 52 | | #10 | | | | | #6 | | | | * | | | | | |
| 51 | | | #10 | | | | | #6 | | | | * | | | | |
| 50 | | | | #10 | #7 | | | | * | | | | | | | |
| 49 | #11 | | | | | #7 | | | | * | | | | | | |
| 48 | | #11 | | | | | #7 | | | | * | | | | | |
| 47 | | | #11 | | | | | #7 | | | | * | | | | |
| 46 | | | | #11 | #8 | | | | * | | | | | | | |
| 45 | #12 | | | | | #8 | | | | * | | | | | | |
| 44 | | #12 | | | | | #8 | | | | * | | | | | |
| 43 | | | #12 | | | | | #8 | | | | * | | | | |
| 42 | | | | #12 | #9 | | | | * | | | | * | | | |
| 41 | #13 | | | | | #9 | | | | * | | | | * | | |
| 40 | | #13 | | | | | #9 | | | | * | | | | * | |
| 39 | | | #13 | | | | | #9 | | | | * | | | | * |
| 38 | | | | #13 | #10 | | | | * | | | | * | | | |
| 37 | | | | | | #10 | | | | * | | | | * | | |
| 36 | | | | | | | #10 | | | | * | | | | * | |
| 35 | | | | | | | | #10 | | | | * | | | | * |
| 34 | | | | | #11 | | | | * | | | | * | | | |
| 33 | | | | | | #11 | | | | * | | | | * | | |
| 32 | | | | | | | #11 | | | | * | | | | * | |
| 31 | | | | | | | | #11 | | | | * | | | | * |
| 30 | | | | | #12 | | | | * | | | | * | | | |
| 29 | | | | | | #12 | | | | * | | | | * | | |
| 28 | | | | | | | #12 | | | | * | | | | * | |
| 27 | | | | | | | | #12 | | | | * | | | | * |
| 26 | | | | | #13 | | | | * | | | | * | | | |
| 25 | | | | | | #13 | | | | * | | | | * | | |
| 24 | | | | | | | #13 | | | | * | | | | * | |
| 23 | | | | | | | | #13 | | | | * | | | | * |
| 22 | | | | | | | | | #10 | | | | * | | | |
| 21 | | | | | | | | | | #10 | | | | * | | |
| 20 | | | | | | | | | | | #10 | | | | * | |

Rm

Sm1

Rr Rrq

PRINTING UP TO EDGE OF PRINTING PAPER WITHOUT PLATEN SOILING

BACKGROUND OF THE INVENTION

1. Field of the Invention

This invention relates to a technique for recording dots on the surface of a printing medium using a dot recording head, and in particular to a technique for printing up to the edges of printing paper, without soiling the platen.

2. Description of the Related Art

In recent years, printers that eject ink from nozzles provided in a print head, such as that illustrated in FIG. 24, have come to enjoy widespread use as computer output devices. As shown in FIG. 24, in a printer of this kind, when it is attempted to record an image up to the upper and lower edges of printer paper without margins, in some instances, ink drops become deposited outside of the printing paper, soiling the platen (see ink drop Ip ejected from nozzle #5 in FIG. 24). One technique for recording images up to the upper and lower edges of printer paper without margins in a printer of this kind is the technique disclosed in JP2002-103584A. In the printer of JP2002-103584A, the edges of the printing paper are arranged over recesses provided in the platen which supports the printing paper, and printing of the image at the edges of the printing paper is carried out by ejecting ink drops from nozzles facing the recessed portions. Printing of the midsectional portion of the printing paper is carried out using nozzles which includes nozzles other than nozzles facing the recessed portions.

In a printer of the sort described above, after printing of the edge portions of the printing paper has been completed, there sometimes is produced in proximity to boundaries between edge portions and the midsectional portion of the printing paper a complicated jigsaw arrangement of main scan lines on which dots have been recorded and main scan lines on which dots have not yet been recorded. Thus, a complicated process was needed in order to switch between edge portion and midsectional portion print modes having different sub-scan feed distances.

In order to address the problems of the prior art discussed above, it is an object of the present invention to provide a technique for easily switching between edge portion and midsectional portion print modes when printing up to the edges of printing paper, without depositing ink drops on the platen.

SUMMARY OF THE INVENTION

In order to address the aforementioned problems, in the present invention, a specific process is carried out in a dot recording device for recording dots on the surface of a printing medium. The recording device comprises: a dot recording head equipped with a plurality of nozzles for ejecting ink drops; a main scan drive unit for driving at least the dot recording head or a printing medium, to perform main scanning; a head drive unit for driving at least some of the plurality of nozzles during main scanning, to carry out formation of dots; a sub-scan drive unit for moving the printing medium in a direction crossing to a direction of the main scanning, at intervals between main scannings; and a control unit for controlling the main scan drive unit, the head drive unit, and the sub-scan drive unit. The dot recording device further comprises a platen disposed extending in the direction of the main scanning so as to face the nozzles over at least a portion of a main scanning path, for supporting the printing medium so that it faces the dot recording head. The platen has a recessed portion disposed extending in the direction of the main scanning at a location facing at least some of the plurality of nozzles.

In such a dot recording device, an edge portion process is performed in which to record dots on a main scan line at a leading edge or trailing edge of the printing medium, ink drops are ejected from at least a portion of a recessed portion nozzle group composed of nozzles that are situated facing the recessed portion, while the leading edge or trailing edge is positioned over an opening of the recessed portion. In the edge portion process, a first unit scan operation is executed a plurality of times in which one or more main scannings are performed to record dots on a plurality of main scan lines that include two or more main scan lines adjacent to one another, and an edge portion process sub-scan is performed by a first feed distance at the interval between first unit scan operations. With such an arrangement, printing up to the edges of printing paper without margins can be carried out without depositing ink drops on the platen, using nozzles situated at locations facing the recessed portions. Additionally, switching between edge portion and midsectional portion print modes can be carried out easily.

The first unit scan operation may comprise a single main scanning. With such an arrangement, printing can be carried out rapidly.

The first unit scan operation may also include a plurality of main scannings, and a sub-scan by a second feed distance which is smaller than the first feed distance performed at the interval between first unit scan operations. With such an arrangement, printing can be carried out with printed results of high quality.

It is preferable that the first feed distance is a feed distance such that a leading edge nozzle of the recessed portion nozzle group is positioned over a main scan line situated adjacently rearward of a main scan line at a trailing edge of a cluster of main scan lines adjacent to one another. In such an arrangement, the cluster of main scan lines has had dots recorded thereon by the recessed portion nozzle group during a proximate first unit scan operation. With such an arrangement, dots can be recorded efficiently, without producing gaps between main scan lines.

In an edge portion process, it is preferable that dots are formed based on the graphics data in which an image to be recorded on the printing medium is set to the outside of the printing medium, beyond the edge on which the edge portion process is performed. By so doing, even where there is positioning error in the relative position of a printing medium and recording head, printing can be performed on the printing medium in portions running out from an intended location, on the basis of an image set outside of the printing medium.

In the edge portion process, it is also preferable that ink drops are not ejected from nozzles not belonging to the recessed portion nozzle group. With such an arrangement, in the event that a printing medium is fed by a lesser or greater feed distance than intended, it is possible to reduce the likelihood of ink drops becoming deposited on structures of the dot recording device other than the recessed portions.

In recording dots on main scan lines in a midsectional portion of the printing medium, it is preferable that a midsectional process is executed in which ink drops are ejected from a greater number of nozzles than in the edge portion process, when the leading edge or trailing edge is not positioned over the opening of the recessed portion. In this arrangement, in the midsectional process, a second unit scan operation is executed a plurality of times in which dots are recorded on a plurality of main scan lines that include two or more adjacent main scan lines, and a midsectional process sub-scan is performed by a third feed distance greater than the first feed distance, at the interval between second unit scan operations. With such an arrangement, recording of dots in the midsectional portion of the printing medium can be carried out rapidly.

In some arrangement, the second unit scan operation may comprise a single main scanning. In another arrangement, the second unit scan operation may include a plurality of main scannings, and a sub-scan by a fourth feed distance which is smaller than the third feed distance performed at the interval between the main scannings. In yet another arrangement, the third feed distance may preferably be a feed distance such that a leading edge nozzle among the nozzles used for the midsectional process is positioned over a main scan line situated adjacently rearward of a main scan line at a trailing edge of a cluster of main scan lines adjacent to one another. In this arrangement, the cluster of lines has had dots recorded thereon during a proximate second unit scan operation.

In case where the edge portion process is executed with the leading edge of the printing medium positioned over the opening of the recessed portion, the following process may be executed. Where the leading edge of the printing medium is positioned over the opening of the recessed portion, and where, assuming that the edge portion process sub-scan and the first unit scan operation will be performed subsequently, a main scan line at a leading edge of edge process unit lines, which are a set of main scan lines that can be recorded by the recessed portion nozzle group in the course of a single first unit scan operation, is situated rearward of a main scan line situated a predetermined distance from the leading edge of the printing medium, the following sub-scan may be performed. The sub-scan is the sub-scan to a relative position such that a main scan line at a leading edge of a midsectional process unit band, which is a cluster of main scan lines that the nozzles used in the midsectional process can record without gaps in a direction of the sub-scan by means of a single second unit scan operation, is aligned with a main scan line situated adjacently rearward of the main scan line situated the predetermined distance from the leading edge of the printing medium. Then, the second unit scan operation is performed, to transition to the midsectional process. With such an arrangement, the transition from an edge portion process to a midsectional process may be made efficiently.

In the edge portion process when the leading edge of the printing medium is positioned over the opening of the recessed portion, where a main scan line at the leading edge of edge process unit lines is situated rearward of a main scan line situated a predetermined distance from the leading edge of the printing medium, the following process may be executed. The edge portion process sub-scan may be performed. Then the second unit scan operation may be performed, to transition to the midsectional process. With such an arrangement, the transition from an edge portion process to a midsectional process may be made efficiently.

In a case where the edge portion process is performed when the trailing edge of the printing medium is positioned over the opening of the recessed portion, the following process may be executed. Where, assuming that the midsectional process sub-scan and the second unit scan operation will be performed subsequently, a main scan line at a trailing edge of a midsectional process unit band, which is a cluster of main scan lines that the nozzles used in the midsectional process can record without gaps in a direction of the sub-scan by means of a single second unit scan operation, is situated rearward from a main scan line situated a predetermined distance from the trailing edge of the printing medium, the following sub-scan may be performed. The sub-scan is the sub-scan to a relative position such that the main scan line at the trailing edge of the midsectional process unit band is aligned with the main scan line situated the predetermined distance from the trailing edge of the printing medium. Next, a first unit scan operation may be performed, transitioning to an edge portion process. With such an arrangement, the transition from an edge portion process to a midsectional process may be made efficiently.

The present invention may be reduced to practice in a number of modes, such as the following.

(1) Dot recording method, printing control method, printing method.

(2) Dot recording device, printing control device, printing device.

(3) Computer program for realizing an aforementioned device or method.

(4) Recording medium having recorded thereon a computer program for realizing an aforementioned device or method.

(5) Data signal embodied in a carrier wave, including a computer program for realizing an aforementioned device or method.

These and other objects, features, aspects and advantages of the present invention will become more apparent from the following detailed description of the preferred embodiments with the accompanying drawings.

BRIEF DESCRIPTION OF THE DRAWINGS

FIG. 14 is an illustration showing the manner of recording graphics data areas corresponding to the midsectional portion and lower edge portion of the printing paper;

DETAILED DESCRIPTION OF INVENTION

The preferred embodiments of the invention are described hereinbelow, in the following order.

A. Summary of Embodiments
B. Embodiment 1
B1. Arrangement of the Device
B2. Print Data
B3: Printing
C. Embodiment 2
D. Embodiment 3
E. Variant Examples
E1. Variant Example 1
E2. Variant Example 2
E3. Variant Example 3
E4. Variant Example 4
E5. Variant Example 5

A. Summary of Embodiments

Figure 1:
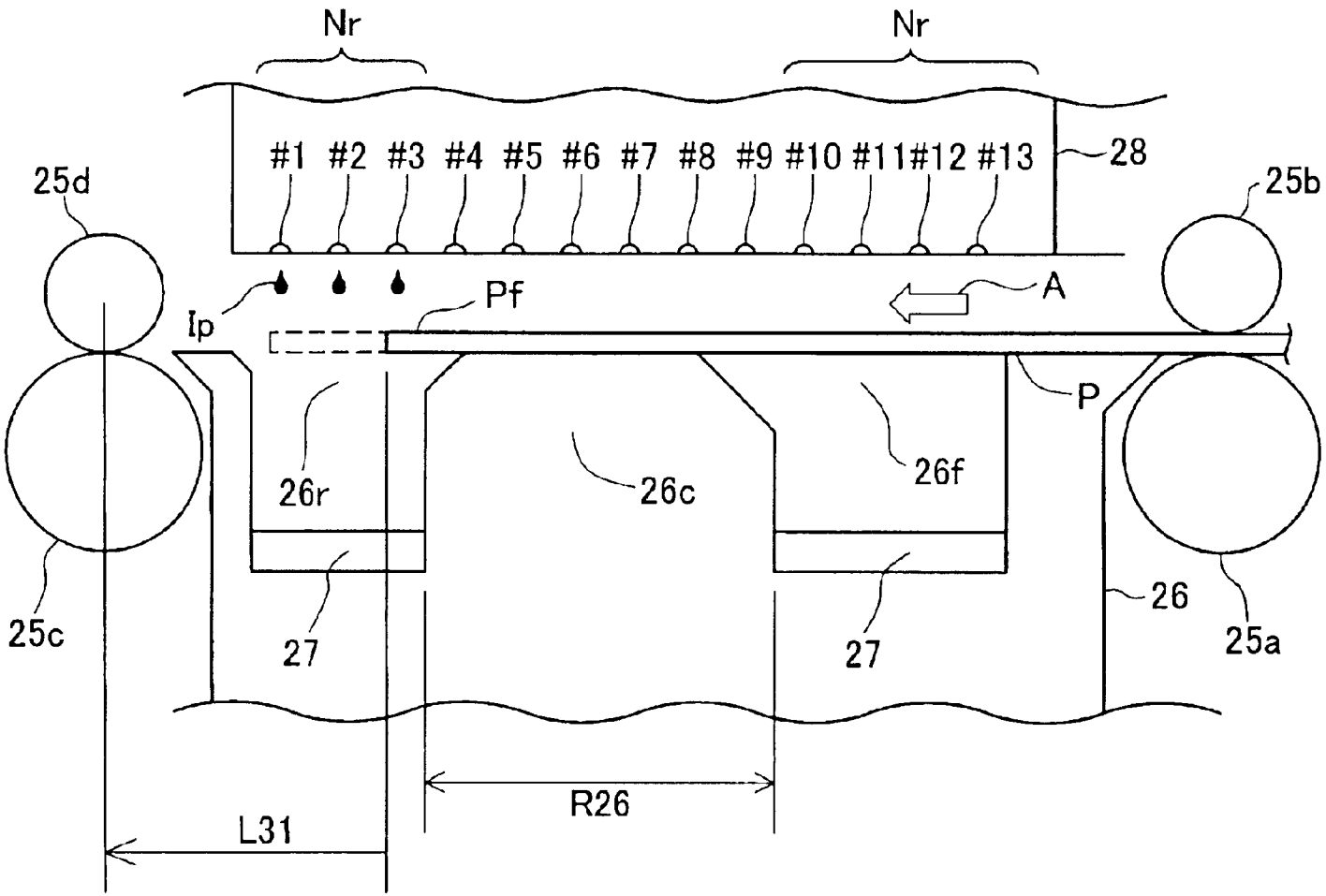
FIG. 1 is a side view showing construction around the print head of an ink jet printer in an embodiment of the invention.

FIG. 1 is a side view illustrating printing of the leading edge portion of printing paper in an embodiment of the invention. In FIG. 1, printing paper P is advanced (sub-scan feed) between upstream paper feed rollers 25*a*, 25*b* so that its leading edge Pf passes over an upstream recessed portion 26*f* and platen 26, to reach the opening of a downstream recessed portion 26*r*. At this point, printing commences by ejecting ink drops Ip from nozzles #1–#3 facing the recessed portion. Since printing commences with the leading edge Pf of printing paper P situated upstream from nozzle #1, even if there is some degree of error in paper feed, the image can be printed up to the edge without any margin at the leading edge Pf of printing paper P. Ink drops not deposited on printing paper P are absorbed by an absorbent member 27.

After printing of the leading edge portion of the printing paper has been completed by means of printing in the above manner, printing of the midsectional portion of the printing paper is carried out using nozzles #1–#13. During both printing of the leading edge portion of the printing paper using nozzles #1–#3 and printing of the midsectional portion of the printing paper using nozzles #1–#13, printing is carried out in units of a band of predetermined width in the printing paper feed direction. Thus, when transitioning from printing of the leading edge portion using nozzles #1–#3 only to printing of the midsectional portion using nozzles #1–#13, printing can be switched efficiently in band units. The same is true of printing of the midsectional portion of the printing paper and printing of the trailing edge portion.

B. Embodiment 1

B1. Arrangement of the Device

Figure 2:
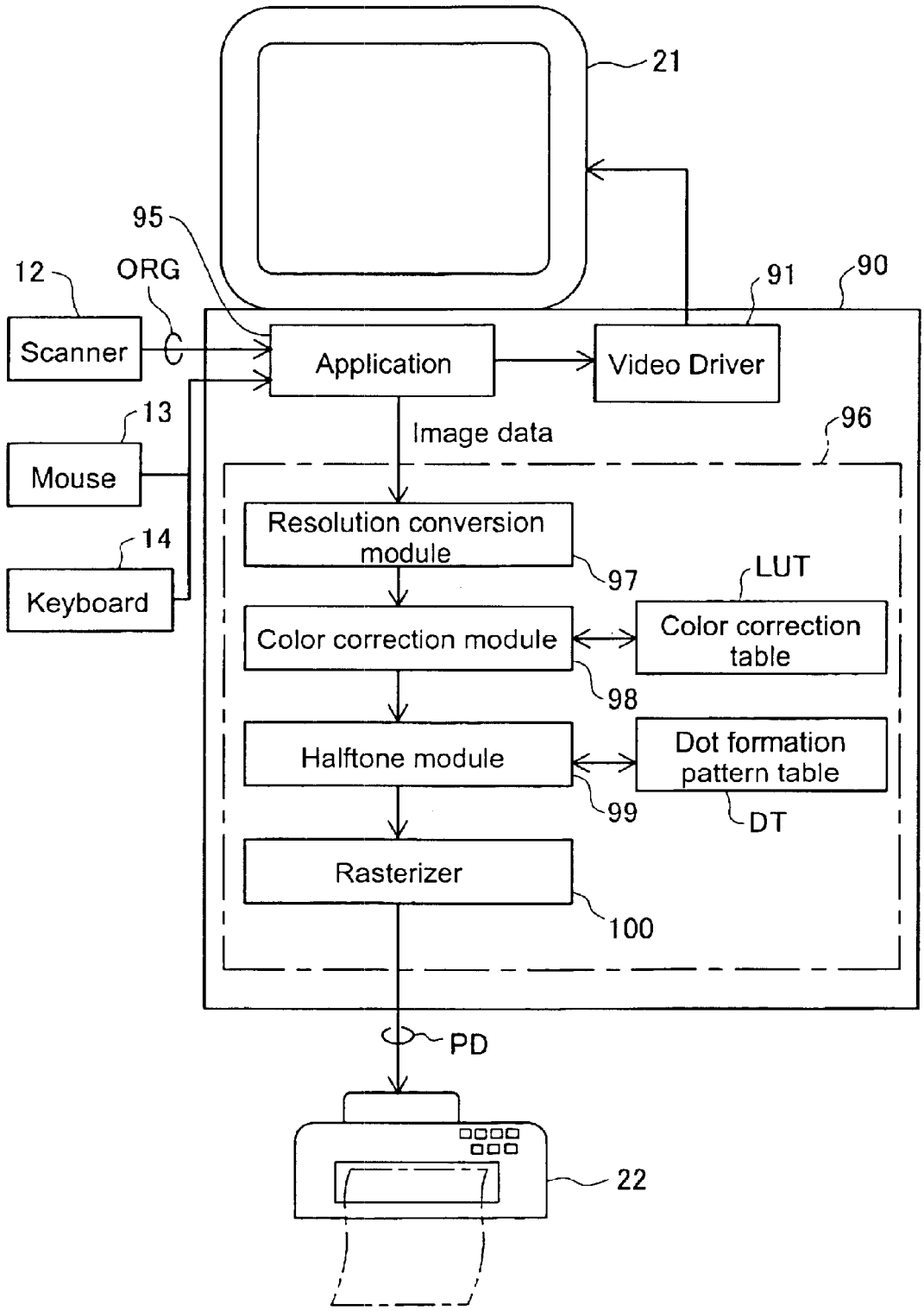
FIG. 2 is a block diagram showing a software configuration of the printing device.

FIG. 2 is a block diagram showing the software configuration of the printing device. On a computer 90, an application program 95 runs on a predetermined operating system. The operating system incorporates, inter alia, a video driver 91 and printer driver 96, whereby the application program 95, via these drivers, is able to output graphics data D for transfer to printer 22. Application 95, which performs image retouching and the like, reads in an image from a scanner 12 and displays the image on a CRT 21 through the agency of the video driver 91 while performing predetermined processes thereon. Data ORG supplied by scanner 22 is read from a color original, and consists of primary color data ORG composed of three color components, namely, red (R), green (G) and blue (B).

When application program 95 issues a print command, the printer driver 96 of computer 90 receives graphics data from application program 95 and converts it to a signal processable by the printer 22 (here, a signal containing multilevel values for the colors cyan, magenta, light cyan, light magenta, yellow and black). In the example illustrated in FIG. 2, printer driver 96 includes a resolution conversion module 97, a color correction module 98, a halftone module 99, and a rasterizer 100. Also in memory are a color correction table LUT and a dot formation pattern table DT.

Resolution conversion module 97 performs the function of converting the resolution of color image data handled by application program 95, i.e. the number of pixels per unit of length, to a resolution that can be handled by the printer driver 96. As the resolution-converted image data still consists of RGB 3-color graphics information, color correction module 98 then converts it, on a pixel-by-pixel basis with reference to color correction table LUT, to data for the colors used by the printer, i.e. cyan (C), magenta (M), light cyan (LC), light magenta (LM), yellow (Y) and black (K). "Pixels" refer to hypothetical grid points established on a printing medium (in some instances, up to outside the printing medium) for the purpose of stipulating locations at which ink drops will be deposited to record dots.

The color-corrected data has a grayscale value range of 256 levels, for example. Halftone module 99 executes a halftone process to reproduce these levels with the printer 22 by means of forming dots in a dispersed manner. By referring to the dot formation pattern table DT, halftone module 99 executes the halftone process upon setting dot formation patterns for ink dots depending on grayscale values of the graphics data. This processed graphics data is arranged by rasterizer 100 in the order in which it will be sent to printer 22, and finally output as print data PD. Print data PD includes raster data, which indicates dot recording status during each main scan, and data indicating sub-scan feed distance. In this embodiment, printer 22 only performs the function of producing ink dots according to print data PD, and does not perform any image processing; however the process could be performed by the printer 22 as well.

A simplified structure of printer 22 is now described with reference to FIG. 3. As shown in the drawing, printer 22 comprises a mechanism for transporting paper P by means of a paper feed motor 23; a mechanism for reciprocating a carriage 31 in the perpendicular direction to the direction of advance of paper P by means of a carriage motor 24; a mechanism for driving a print head 28 carried on carriage 31 to eject ink and form ink dots; and a control circuit 40 for exchanging signals with paper feed motor 23, carriage motor 24, print head 28 and a control panel 32.

The mechanism for reciprocating carriage 31 in the axial direction of platen 26 comprises a slide rail 34 spanning the direction perpendicular to the printing paper P feed direction, for slidably retaining carriage 31; a pulley 38 about which is attached an endless drive belt 36 that extends between carriage 31 and carriage motor 24; and a position sensor 39 for sensing the home position of carriage 31.

A black ink (K) cartridge 71 and a color ink cartridge 72 containing inks of six colors, namely, cyan (C), light cyan (LC), magenta (M), light magenta (LM), and yellow (Y) are installable on carriage 31. On the print head 28 at the bottom of carriage 31 are formed a total of six ink eject heads 61 to 66; when the black ink (K) cartridge 71 and color ink cartridge 72 are installed on the carriage 31 from above, ink can be supplied from the ink cartridges to the ink eject heads 61 to 66.

Figure 4:
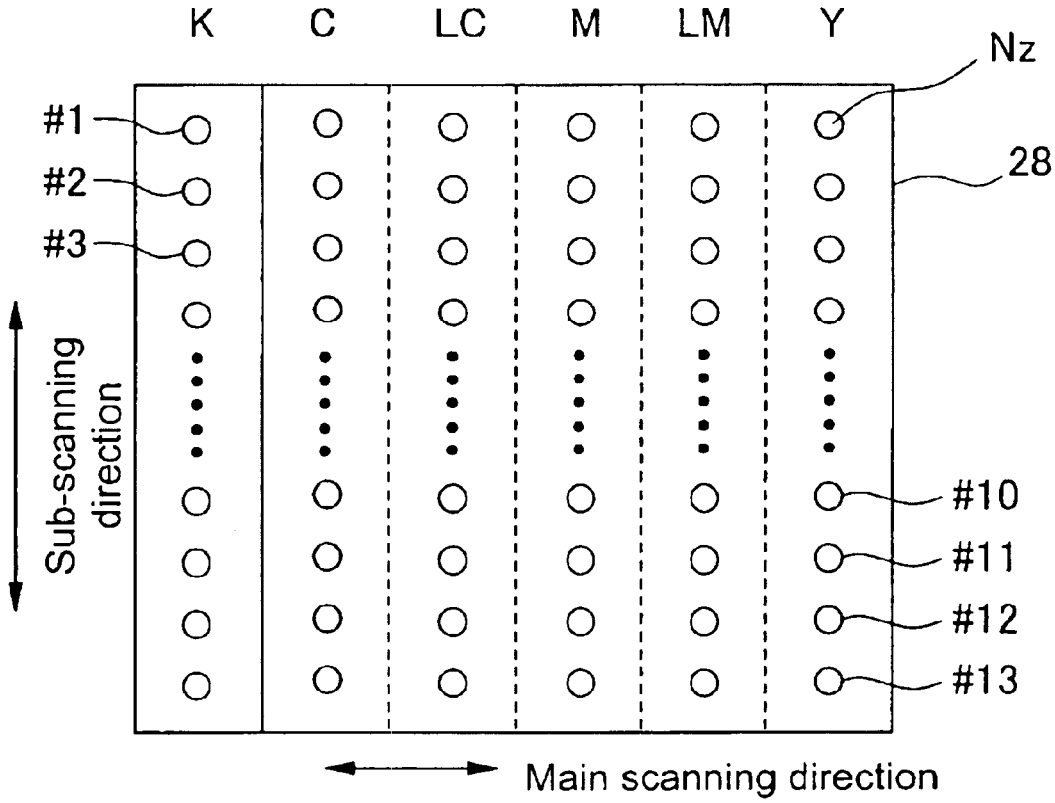
FIG. 4 is a plan view showing an example of nozzle unit arrangement for each color in print head unit 60.

FIG. 4 illustrates an arrangement of ink jet nozzles Nz on print head 28. The nozzle arrangement is composed of six nozzle arrays for ejecting inks of the colors black (K), cyan (C), light cyan (LC), magenta (M), light magenta (LM), and yellow (Y); the thirteen nozzles of each array are arranged in a single row at a predetermined nozzle pitch k. The six nozzle arrays are in turn arranged in a row in the main scanning direction. "Nozzle pitch" herein refers to a value indicating spacing in the sub-scan direction of nozzles arranged on the print head, expressed in terms of dots (i.e. in terms of pixels).

Figure 5:
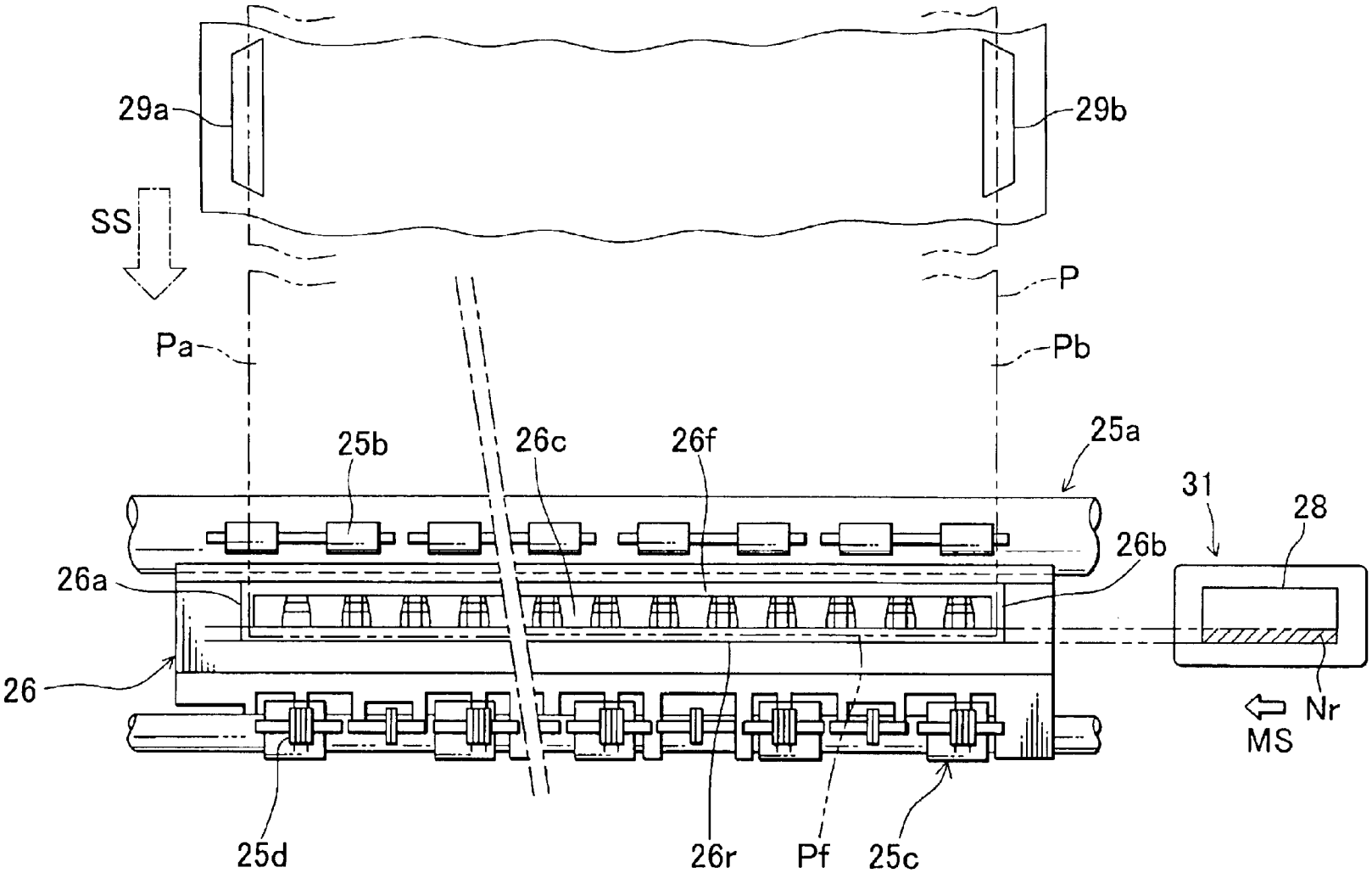
FIG. 5 is a plan view showing the area around platen 26.

FIG. 5 is a plan view of the area around the platen 26. Platen 26 has length in the main scan direction (indicated by arrow MS) that is greater than the maximum width of printer paper P that can be used in printer 22. At the upstream end of platen 26 are disposed upstream paper feed rollers 25*a*, 25*b*. Whereas upstream paper feed roller 25*a* consists of a single drive roller, upstream paper feed roller 25*b* is composed of a plurality of freely rotating small rollers. At the downstream end of the platen are disposed downstream paper feed rollers 25*c*, 25*d*. Downstream paper feed roller 25*c* is composed of a plurality of rollers on a drive shaft, and downstream paper feed roller 25*d* is composed of a plurality of freely rotating small rollers. On the outer peripheral face of downstream paper feed roller 25*d* are disposed recesses parallel to the rotation axis. That is, downstream paper feed roller 25*d* has radial "teeth" (portions lying between adjacent recesses) on its outer peripheral face, giving it the appearance of a gear when viewed along the rotation axis. This downstream paper feed roller 25*d* is commonly known as a "serrated roller" and has the function of pressing printing paper P against platen 26. Downstream paper feed roller 25*c* and upstream paper roller 25*a* turn in sync so that their outer peripheral speeds are equal.

During main scans in the direction indicated by arrow MS, carriage 31, with print head 28 installed thereon, reciprocates across platen 26 situated between upstream paper feed rollers 25*a*, 25*b* and downstream paper feed rollers 25*c*, 25*d*. Printing paper P is retained by upstream paper feed rollers 25*a*, 25*b* and downstream paper feed rollers 25*c*, 25*d*, and supported on the upper face of platen 26 so that the portion of the paper between the sets of rollers facing the nozzle rows of print head 28. Sub-scan feed in the direction indicated by arrow SS is carried out by upstream paper feed rollers 25*a*, 25*b* and downstream paper feed rollers 25*c*, 25*d*, to serially record an image with ink ejected from the nozzles of print head 28. On occasion, upstream paper feed rollers 25*a*, 25*b* are herein referred to as the "upstream sub-scan drive unit", and downstream paper feed rollers 25*c*, 25*d* as the "downstream sub-scan drive unit."

On platen 26 are disposed an upstream recessed portion 26*f* and a downstream recessed portion 26*r* respectively situated upstream and downstream in the sub-scanning direction (see FIG. 1). Upstream recessed portion 26*f* and downstream recessed portion 26*r* each extend in the main scanning direction (indicated by arrow MS) over a distance greater than the maximum width of printing paper P useable in printer 22.

Downstream recessed portion 26*r* is disposed at a location facing a downstream nozzle group Nr (nozzles situated in the hatched portion in FIG. 5), which group is composed of some of the nozzles Nz on print head 28, including those situated furthest downstream. Upstream recessed portion 26*f* is disposed at a location facing an upstream nozzle group Nf (not shown in FIG. 5), which group is composed of some of the nozzles Nz on print head 28, including those situated furthest upstream. Specifically, as shown in FIG. 1, nozzle group Nr, which is situated facing downstream recessed portion 26*r*, is composed of nozzles #1–#3 of each nozzle row. Nozzle group Nf, which is situated facing upstream recessed portion 26*f*, is composed of nozzles #10–#13 of each nozzle row.

Printer 22 further comprises guides 29*a*, 29*b* for guiding printing paper P so that it maintains a predetermined position in the main scanning direction during sub-scanning of printing paper P. On platen 26 are disposed a left recessed portion 26*a* and a right recessed portion 26*b* which extend in the sub-scanning direction to connect the two ends of upstream recessed portion 26*f* to those of downstream recessed portion 26*r*. Left recessed portion 26*a* and right recessed portion 26*b* are disposed over an area in the sub-scanning direction that is greater in length than the area over which ink drops are deposited by the nozzle rows on the print head. Left recessed portion 26*a* and right recessed portion 26*b* are situated with the space between their respective center lines (in the main scanning direction) equal to the width of printing paper P in the main scanning direction.

Upstream recessed portion 26*f*, downstream recessed portion 26*r*, left recessed portion 26*a* and right recessed portion 26*b* interconnect to form a quadrangular recessed portion. An absorbent member 27 for receiving and absorbing ink drops is disposed at the bottom thereof (see FIG. 1).

As printing paper P is sub-scanned by upstream feed rollers 25*a*, 25*b* and downstream feed rollers 25*c*, 25*d*, it passes over the openings of upstream recessed portion 26*f* and downstream recessed portion 26*r*. Printing paper P is positioned on platen 26 by guides 29*a*, 29*b* so that its left edge portion Pa is situated over left recessed portion 26*a* and its right edge portion Pb is situated over right recessed portion 26*b*. Thus, during sub-scanning, the two side edges of printing paper P are maintained in positions over left recessed portion 26*a* and right recessed portion 26*b*, respectively, as the paper advances.

Figure 3:
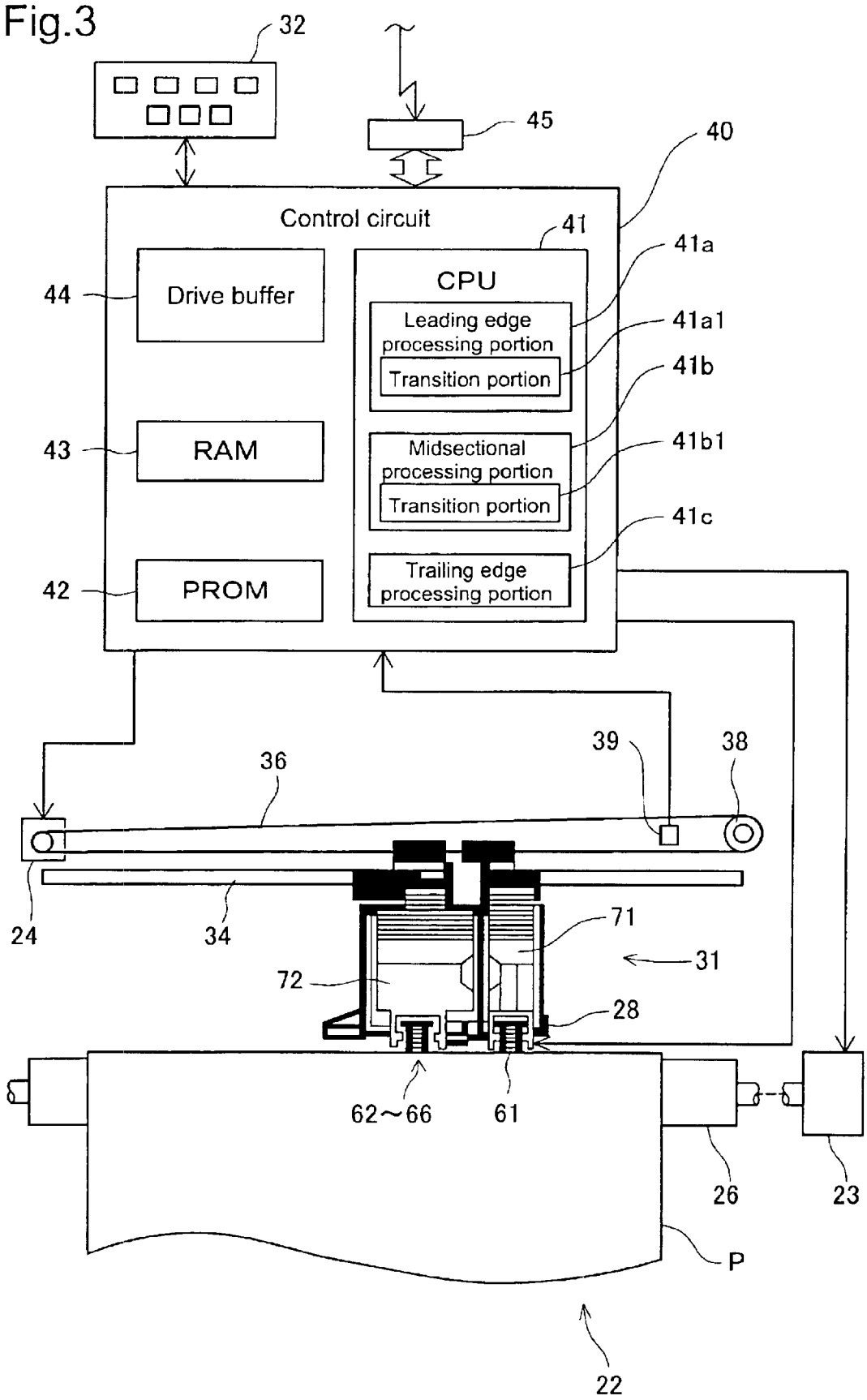
FIG. 3 is an illustration of a simplified configuration of printer 22.

Referring now to FIG. 3, the internal arrangement of control circuit 40 of printer 22 will be described. Within control circuit 40 are provided a CPU 41, PROM 42 and RAM 43, as well as a PC interface 45 for exchange of data with computer 90, a drive buffer 44 for outputting ink dot ON/OFF signals to ink eject heads 61–66, and the like, these elements and circuits being interconnected via a bus. Control circuit 40 receives dot data processed by computer 90 and temporarily stores it in RAM 43, from which it is output under predetermined timing to drive buffer 44.

Printer 22 having the hardware configuration described above advances paper P by means of paper feed motor 23 while reciprocating the carriage 31 by means of carriage motor 24, while at the same time driving the piezo elements of the nozzle units of print head 28 to eject ink drops Ip of the required colors, thereby forming ink dots to produce a multicolor image on paper P.

B2. Print Data

Figure 6:
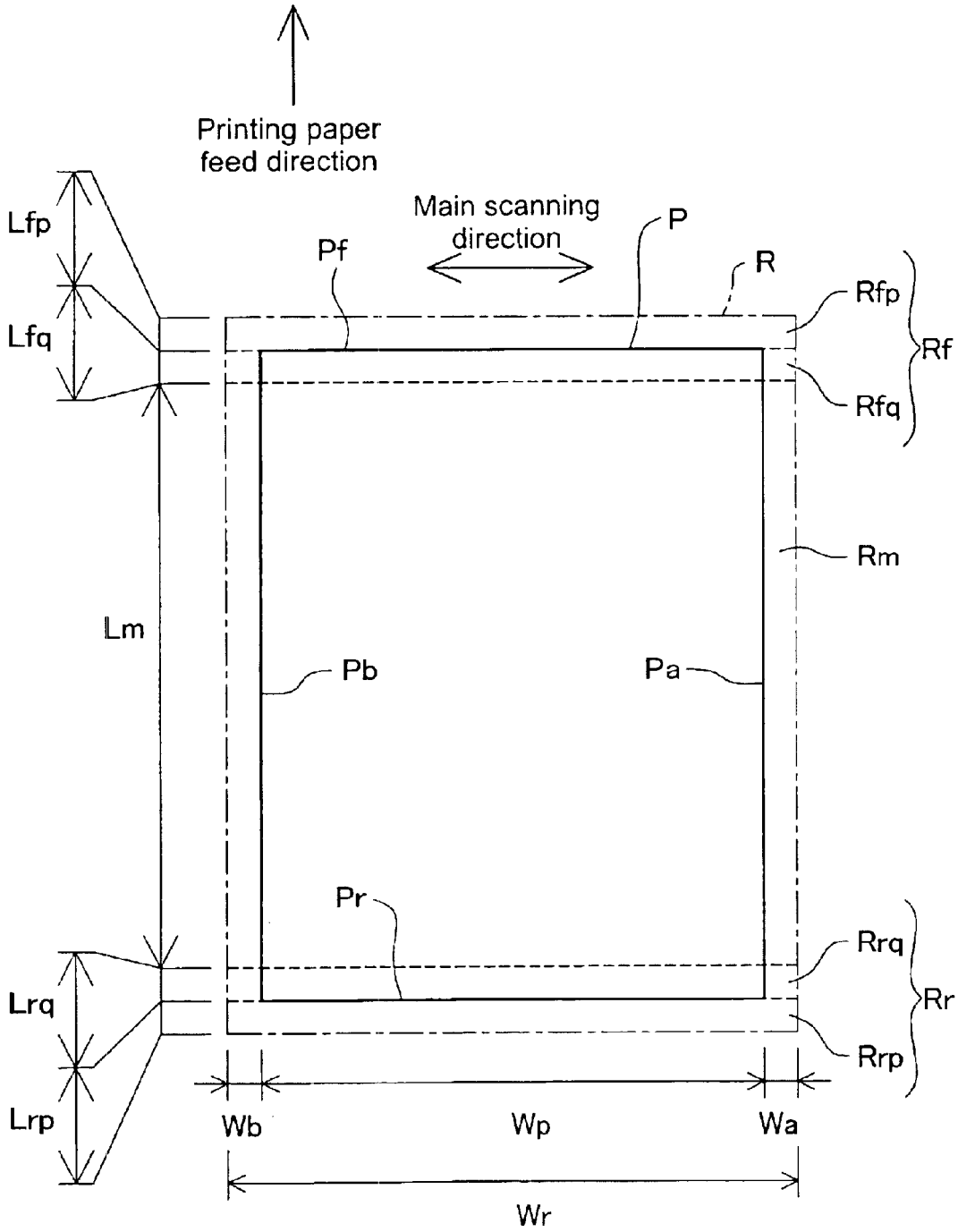
FIG. 6 is an illustration showing the relationship between image recording area R and printing paper P.

FIG. 6 is an illustration showing the relationship between an image recording area R and printing paper P. In this embodiment, the image recording area R is set extending to the outside of printing paper, beyond the leading edge Pf of printing paper P. Similarly, for the lower edge Pr, left edge Pa, and right edge Pb of printing paper P, the image recording area R is set to extend to the outside of printing paper, beyond the edges of printing paper P. Accordingly, in this embodiment, relationships between image recording area R during printing, the size of printing paper P, and between the hypothetical location of image recording area R and placement of printing paper P, are as shown in FIG. 6. Hereinafter, this image recording area shall be termed "extended area R." With regards to the designations of left and right for the left edge Pa and right edge Pb of printing paper P, designations of left and right for the left edge Pa and right edge Pb of printing paper P are reversed from left and right in FIG. 6, so as to correspond to the designations of left and right for printer 22.

In Embodiment 1, dimensions in the main scanning direction (left-right direction in FIG. 6) of those portions of extended area R that are set beyond the left edge Pa and right edge Pb of printing paper P are assumed constant regardless of the type of printing paper. Accordingly, where the width of the printing paper in the main scanning direction is designated Wp (this differs depending on the type of paper), the width of that portion of extended area R set beyond left edge Pa is designated Wa (a constant value), and the width of that portion of extended area R set beyond right edge Pb is designated Wb (a constant value), the width Wr of the extended area will be given by the equation Wr=Wp+Wa+Wb. The width Wr of extended area R exceeds the left-right width of printing paper P, but is less than the space between the outer side walls of left recessed portion 26*a* and right recessed portion 26*b*.

In contrast to this, dimensions in the sub-scanning direction (vertical direction in FIG. 6) of those portions of extended area R that are set beyond the leading edge Pf and lower edge Pr of printing paper P differ depending on the sub-scanning direction dimension of printing paper P, and the material of which it is made (cases of materials other than paper are also included). The portion of extended area R that is set beyond the leading edge Pf is termed the outside leading edge portion Rfp of the recording area, and the portion of extended area R that is set beyond the lower edge Pr is termed the outside trailing edge portion Rrp of the recording area.

Outside leading edge portion Rfp is recorded exclusively by downstream nozzle group Nr, which is composed of those nozzle rows of print head 28 that are situated at locations facing downstream recessed portion 26*r* (see FIG. 1). Like outside leading edge portion Rfp, that portion of extended area R that is situated inwardly from leading edge Pf of printing paper P and adjacently to outside leading edge portion Rfp is recorded exclusively by downstream nozzle group Nr. This portion is termed inside leading edge portion Rfq. Outside leading edge portion Rfp and inside leading edge portion Rfq are together referred to as leading edge portion Rf of extended area R. For example, in printing paper P having the maximum width accommodated by printer 22, the sub-scanning direction width Lfp of outside leading edge portion Rfp is equivalent to eight main scan lines, and the sub-scanning direction width Lfq of inside leading edge portion Rfq is equivalent to twelve main scan lines.

On the other hand, outside trailing edge portion Rrp is recorded exclusively by upstream nozzle group Nf, which is composed of those nozzle rows of print head 28 that are situated at locations facing upstream recessed portion 26*f* (see FIG. 1). Like outside trailing edge portion Rrp, that portion of extended area R that is situated inwardly from lower edge Pr of printing paper P and adjacently to outside trailing edge portion Rrp is recorded exclusively by upstream nozzle group Nf. This portion is termed inside trailing edge portion Rrq. Outside trailing edge portion Rrp and inside trailing edge portion Rrq are together referred to as trailing edge portion Rr of extended area R. For example, in printing paper P having the maximum width accommodated by printer 22, the sub-scanning direction width Lrp of outside trailing edge portion Rrp is equivalent to twelve main scan lines, and the sub-scanning direction width Lrq of inside trailing edge portion Rrq is equivalent to ten main scan lines.

B3: Printing (1) Midsectional Process

In the printer of the present embodiment, in order to carry out printing with the leading edge Pf of printing paper over downstream recessed portion 26*r* and the trailing edge Pr over upstream recessed portion 26*f*, a printing process that is different from that for the midsectional portion of the printing paper is employed in proximity to the leading and trailing edges of the printing paper. The printing process employed in the midsectional portion of the printing paper shall herein be referred to as the "midsectional process", the printing process employed in proximity to the leading edge of printing paper as the "leading edge process", and the printing process employed in proximity to the trailing edge of printing paper as the "trailing edge process." The leading edge process and trailing edge process shall collectively be referred to as the "leading/trailing edge process."

Herein, where the edges of printing paper P are referred to in relation to vertical placement of graphics data recorded on printing paper P, the terms "upper edge (portion)" and "lower edge (portion)" are sometimes used; or where the edges of printing paper P are referred to in relation to the direction of advance of sub-scan feed of printing paper P through printer 22, the terms "leading edge (portion)" and "trailing edge (portion)" are used. With regards to the indication of nozzle position within nozzle groups (nozzle rows) as well, where indicating nozzle position in relation to vertical placement of graphics data recorded on printing paper P, the terms "upper edge (portion)" and "lower edge (portion)" are sometimes used; or where indicating nozzle position in relation to the direction of advance of sub-scan feed of printing paper P through printer 22, the terms "leading edge (portion)" and "trailing edge (portion)" are used. Herein, with reference to printing paper P, "upper edge (portion)" corresponds to "leading edge (portion)", and "lower edge (portion)" corresponds to "trailing edge (portion)." Expressed in terms of the direction of feed of the printing paper when transporting the printing paper, "upper edge" and "leading edge" refer to the edge situated in the downstream direction of the sub-scan feed, and "lower edge" and "trailing edge" refer to the edge situated in the upstream direction of the sub-scan feed. When describing recording dots onto printing paper herein, the direction of the leading edge when printing paper P is advanced by paper feed motor 22 is on occasion termed "upward", and the direction of the trailing edge termed "downward."

Figure 7:
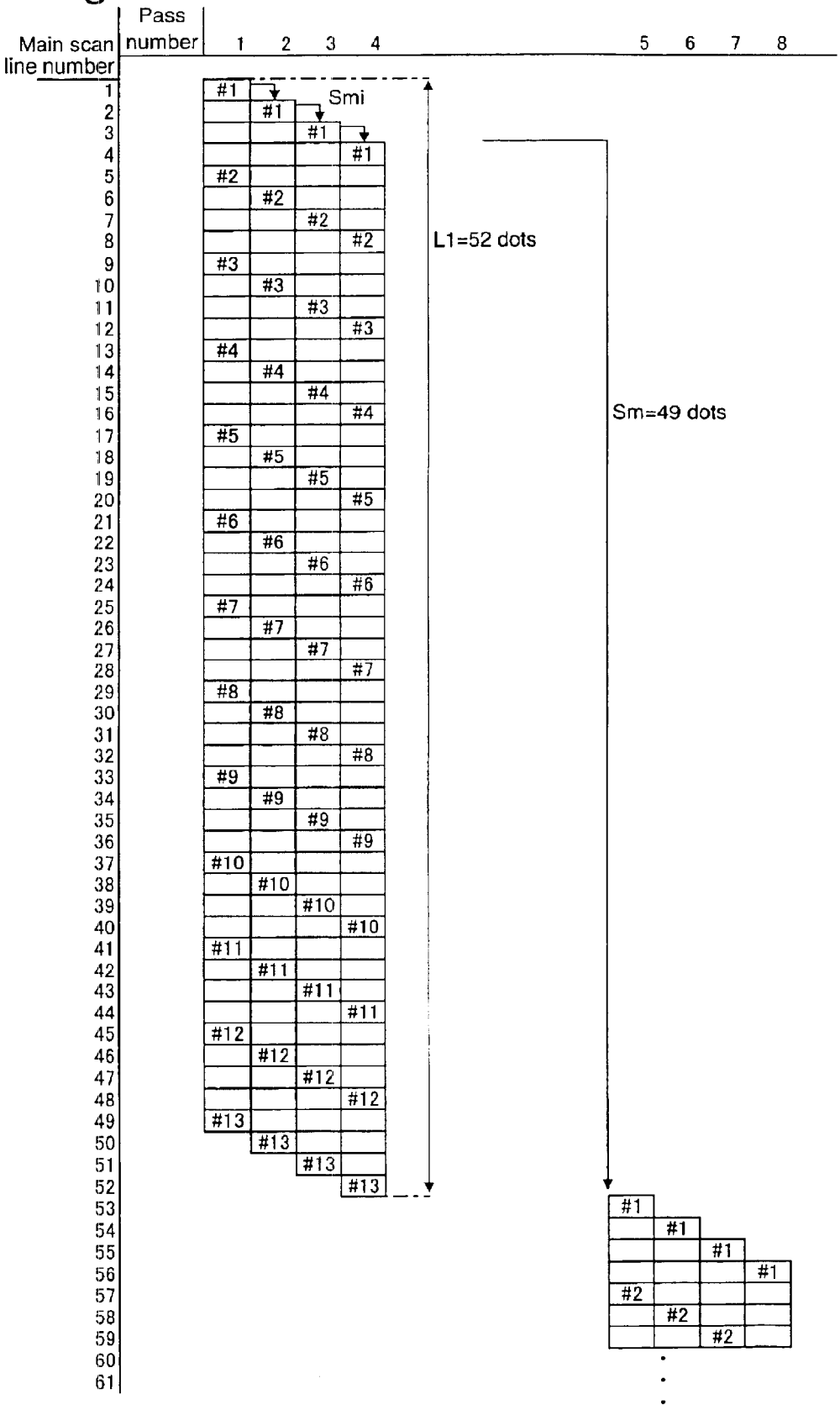
FIG. 7 is an illustration showing recording of dots onto main scan lines by means of a unit scan operation in a midsectional process.

FIG. 7 is an illustration showing recording of dots onto main scan lines by means of a unit scan operation in a midsectional process. "Main scan line" refers to a collection of pixels lined up in the main scanning direction. Whereas in actual practice, as printing paper P is transported relative to the print head, the relative position of the two changes (see FIG. 1), in FIG. 7, the print head is depicted as moving downwardly relative to printing paper P, in order to simplify the description. The numbers preceded by a "#" appearing in the grid cells indicate numbers assigned to nozzles recording the main scan line. This convention is used in all subsequent drawings describing recording of main scan lines.

Each main scan line consists of a row of pixels extending in the left-right direction in FIG. 7. Spacing between main scan lines situated adjacently in the vertical direction is denoted as D. As will be apparent from FIG. 7, nozzle pitch in the vertical (sub-scanning) direction on the print head is equal to 4×D. Herein, spacing between adjacent main scan lines is denoted as "1 dot." Therefore, nozzle pitch k on the print head is equal to 4 dots. With regards to the notation of sub-scan feed distance as well, notation is given in dot units based on spacing between main scan lines.

When performing printing in Embodiment 1, fine feed (sub-scanning) involving a 1-dot feed distance each time is performed at intervals between main scans, to carry out a unit scan operation that entails main scanning k times (where k is nozzle pitch). By means of this unit scan operation, dots are recorded in a band composed of a plurality of main scan lines situated adjacent to one another in the sub-scanning direction. At intervals between unit scan operations, advance by a large distance is carried out, to serially record main scan lines on the printing paper in units of bundle of several main scan lines. As shown in FIG. 7, in leading edge processing in Embodiment 1, a single unit scan operation is completed by repeating 1-dot feed three times and performing main scanning four times. Each single main scan is termed a "pass."

As shown in FIG. 7, when a unit scan operation is performed using all 13 nozzles of the nozzle rows, the number L1 of main scan lines recorded by each ink and lined up in the sub-scanning direction with no gaps therebetween is equal to 52. Sets of main scan lines recorded during unit scan operations using all nozzles of nozzle rows are termed "midsectional process unit lines", and, of these, clusters of lines lined up in the sub-scanning direction with no gaps therebetween are termed "midsectional process unit band." In Embodiment 1, as feed by 1-dot increments is performed at intervals between main scans, the "midsectional process unit lines" and "midsectional process unit band" coincide. In a midsectional process that entails performing unit scan operations using all nozzles of nozzle rows, a "midsectional process sub-scan" by a feed distance Sm of 49 dots is performed after one unit scan operation has been completed, before proceeding to the next unit scan operation. As shown in FIG. 7, feed by a feed distance Smi of 1 dot is performed three times during a unit scan operation, so once a midsectional process sub-scan and a unit scan operation have been performed, the print head 28 will have been advanced by a total of 52 dots.

"Using (all) nozzles" herein refers simply to the possibility of using those nozzles during printing in a particular mode. Accordingly, depending on the particular content of graphics data, specific nozzles may not be used in actual practice. In the event that, for convenience in sub-scanning, nozzles ejecting a certain color of ink pass over main scan lines previously recorded with this same color of ink, those nozzles will not be used in some instances. In addition to graphics data, print data also includes hypothetical pixel pitch data, sub-scan feed distance data, and the like. The term "image" herein refers not only to pictures, but includes also any manner of subject recordable onto a printing medium, such as text, symbols, line drawings, and the like.

(2) Leading Edge Process

Figure 8:
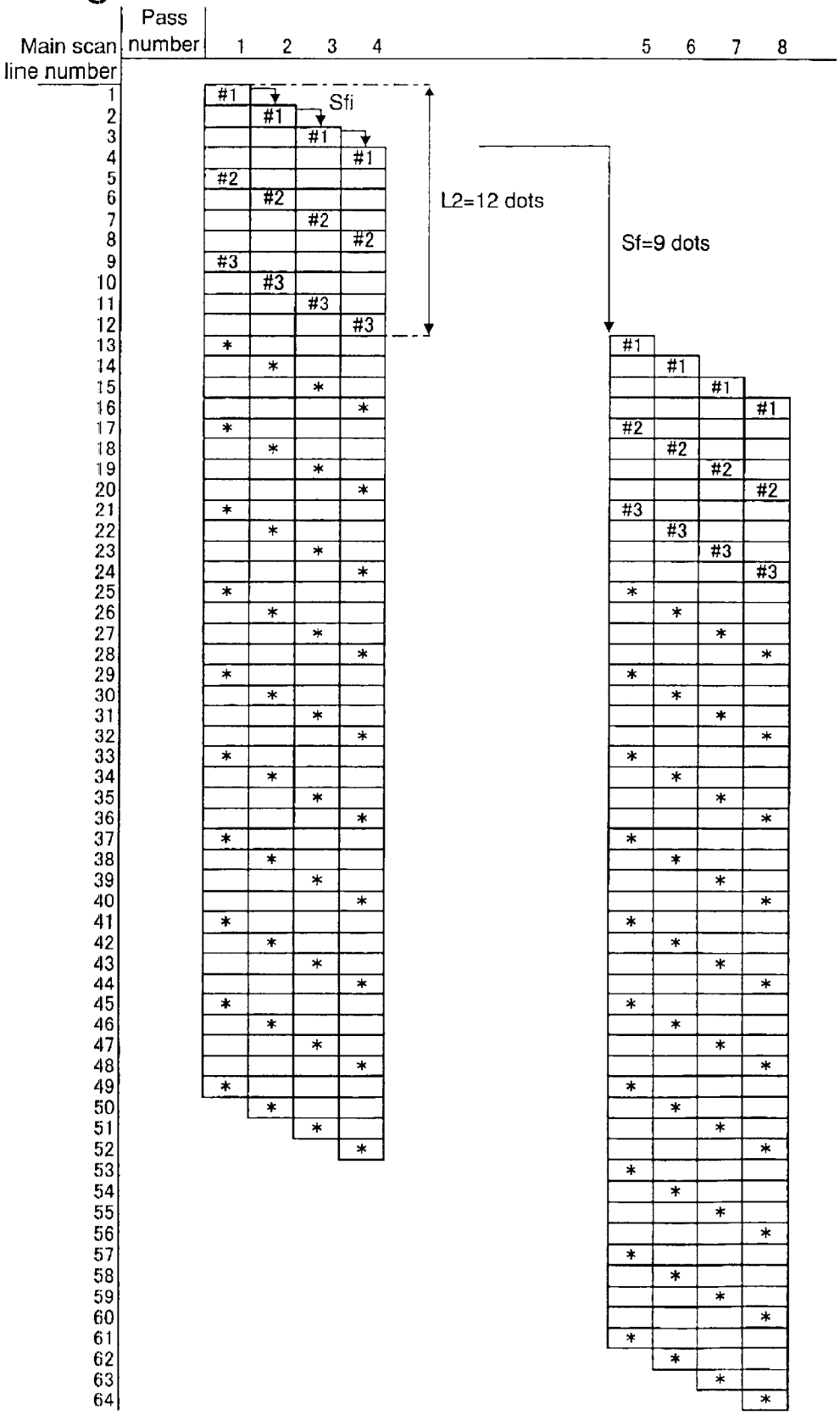
FIG. 8 is an illustration showing recording of dots onto main scan lines by means of a unit scan operation in a leading edge portion process.

FIG. 8 is an illustration showing recording of dots onto main scan lines by means of a unit scan operation in an edge portion process. In the leading edge process, dots are recorded using only the downstream recessed portion 26*r*-facing nozzles #1–#3 of each nozzle row (see FIG. 1 and FIG. 5). In FIG. 8, only nozzle positions of nozzles #1–#3 used in printing are shown; locations of nozzles not used in printing are indicated by a "*".

As shown in FIG. 8, the number L2 of main scan lines recorded with no gaps therebetween in the sub-scanning direction when unit scan operations are carried out using the downstream recessed portion nozzle group is 12. The set of main scan lines that can be recorded in the sub-scanning direction by downstream recessed portion nozzle group Nr during a single unit scan operation is termed "leading edge process unit lines" in particular. The cluster of lines that can be recorded, with no gaps therebetween in the sub-scanning direction, by downstream recessed portion nozzle group Nr during a single unit scan operation are termed "leading edge process unit band" in particular. In the leading edge process, a "leading edge process sub-scan" having a 9-dot feed distance is performed after one unit scan operation has finished, before proceeding to the next unit scan operation. As shown in FIG. 8, feed by a feed distance Sfi of 1 dot is performed three times during a unit scan operation, so once a leading edge process sub-scan and a unit scan operation have been performed, the print head 28 will have been advanced by a total of 12 dots.

In the leading edge process, printing is carried out using only nozzles at locations facing the downstream recessed portion (see FIG. 1 and FIG. 5). Accordingly, ink drops ejected from nozzles do not become deposited on the platen, even if they are not deposited on the printing paper. Thus, even in the event that the printing paper has not been advanced properly, ink drops will not become deposited on the platen in the leading edge process.

In the leading edge process, recording of dots using nozzles facing the recessed portion is carried out not only when the leading edge of the printing paper is situated over the recessed portion opening, but also before and after this time, i.e., when the leading edge of the printing paper is not situated over the recessed portion opening.

(3) Trailing Edge Process

Figure 9:
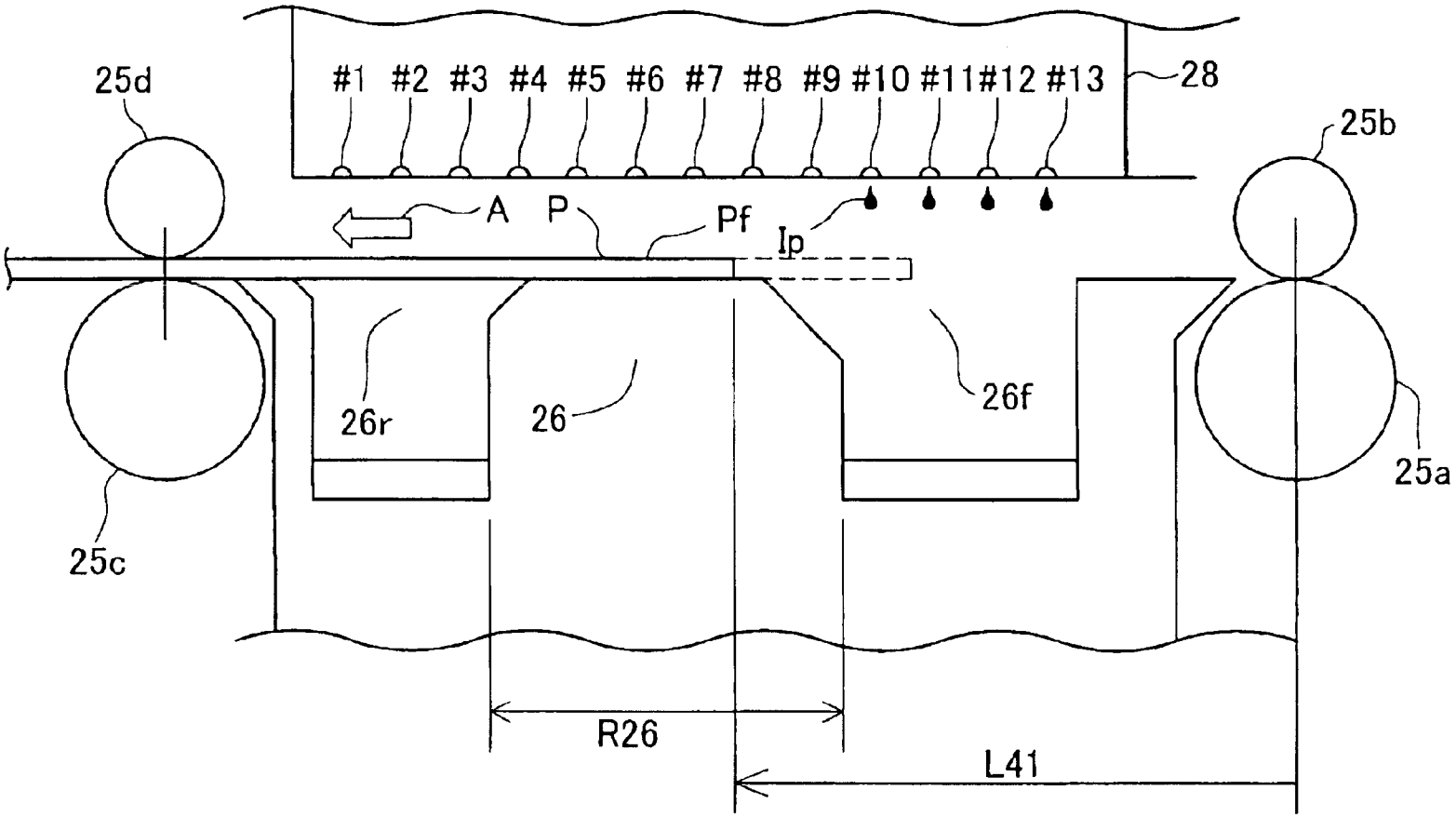
FIG. 9 is a side view showing the relationship between upstream recessed portion **26*f*** and printing paper P when printing the trailing edge portion Pr of printing paper P.
Figure 10:
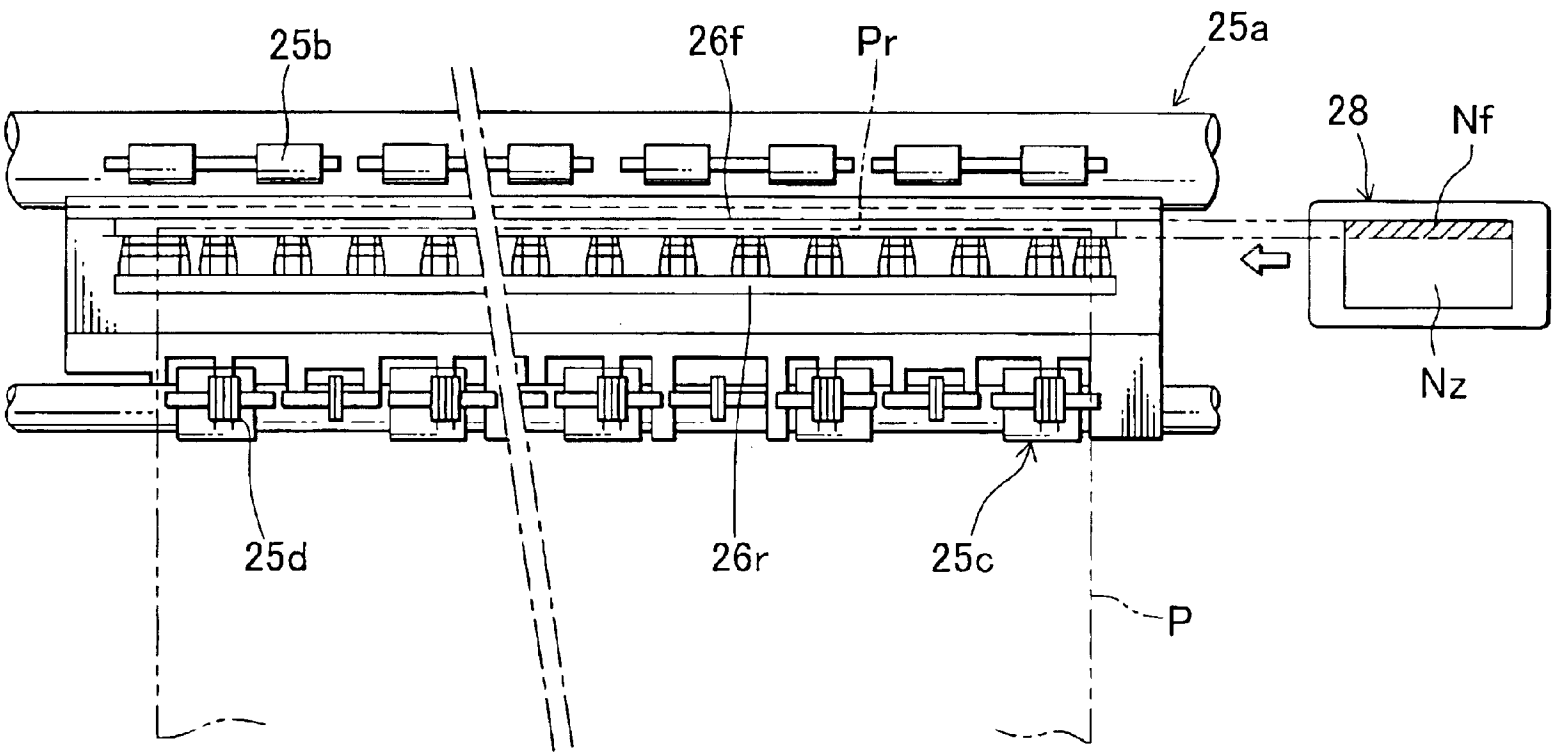
FIG. 10 is a plan view showing the relationship between upstream recessed portion **26*f*** and printing paper P when printing the trailing edge portion Pr of printing paper P.

FIG. 9 is a side view showing the relationship between upstream recessed portion 26*f* and printing paper P when printing the trailing edge portion Pr of printing paper P. FIG. 10 is a plan view showing the relationship between upstream recessed portion 26*f* and printing paper P when printing the trailing edge portion Pr of printing paper P. In FIG. 10, the hatched portion of print head 28 is the portion where nozzles #10–#13 (upstream recessed portion nozzle group Nf), situated facing upstream recessed portion 26*f*, are located. In the trailing edge process, dots are recorded using only the upstream recessed portion 26*f*-facing nozzles #10–#13 of each nozzle row.

Figure 11:
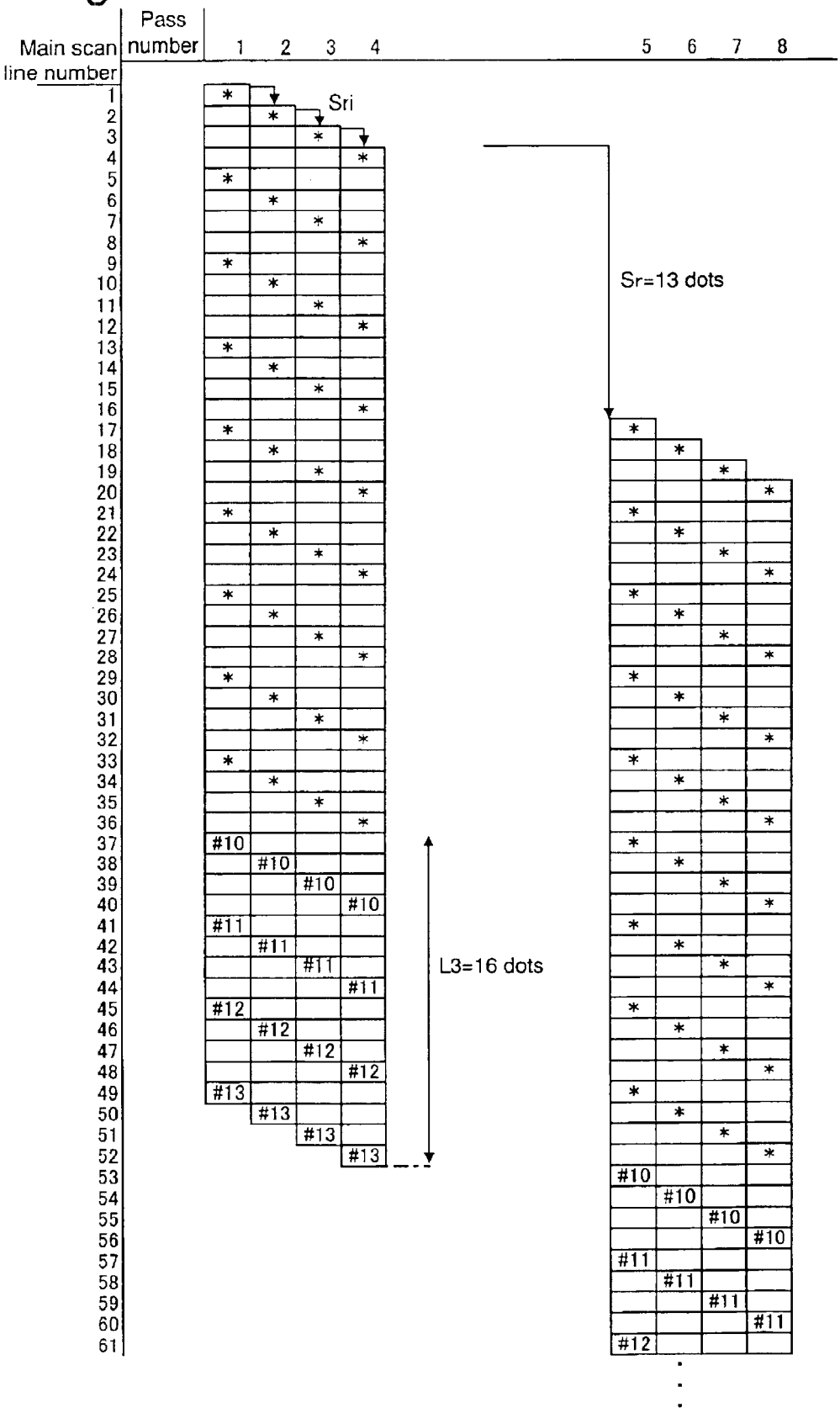
FIG. 11 is an illustration showing recording of dots onto main scan lines by means of a unit scan operation in a trailing edge portion process.

FIG. 11 is an illustration showing recording of dots onto main scan lines by means of a unit scan operation in a trailing edge portion process. As shown in FIG. 11, the number L3 of main scan lines recorded with no gaps therebetween in the sub-scanning direction when unit scan operations are carried out using the upstream recessed portion nozzle group is 16. The cluster of lines that can be recorded, with no gaps therebetween in the sub-scanning direction, by the upstream recessed portion nozzle group during a single unit scan operation are termed "trailing edge process unit band" in particular. In the trailing edge process, a "trailing edge process sub-scan" having a 13-dot feed distance is performed after one unit scan operation has finished, before proceeding to the next unit scan operation. As shown in FIG. 11, feed by a feed distance Sri of 1 dot is performed three times during a unit scan operation, so once a leading edge process sub-scan and a unit scan operation have been performed, the print head 28 will have been advanced by a total of 16 dots. In the leading edge process, midsectional process, and trailing edge process, the total of the feed distance of the sub-scan performed at intervals between unit scan operations and the feed distance of all sub-scans performed during a unit scan operation is equal to the number of main scan lines recorded when a unit scan operation is performed.

In the trailing edge process, printing is carried out using only nozzles at locations facing the upstream recessed portion (see FIG. 9 and FIG. 10). Accordingly, ink drops ejected from nozzles do not become deposited on the platen, even if they are not deposited on the printing paper. Thus, even in the event that the printing paper has not been advanced properly, ink drops will not become deposited on the platen in the trailing edge process.

In the leading edge and trailing edge processes, the feed distance of sub-scans carried out during a unit scan operation is preferably 1 dot, as in Embodiment 1. By so doing, the edges portions of the printing medium can be recorded using nozzles close to the edges in the sub-scanning direction of the dot recording head.

In the trailing edge process, recording of dots using nozzles facing the recessed portion is carried out not only when the trailing edge of the printing paper is situated over the recessed portion opening, but also before and after this time, i.e., when the leading edge of the printing paper is not situated over the recessed portion opening. The leading edge process is executed by means of a leading edge processing portion 41*a*, and midsectional processing by means of a midsectional processing portion 41*b*. The trailing edge process is executed by means of a trailing edge processing portion 41*c* (see FIG. 3).

(4) Transitioning from Leading Edge Process to Midsectional Process

Figure 12:
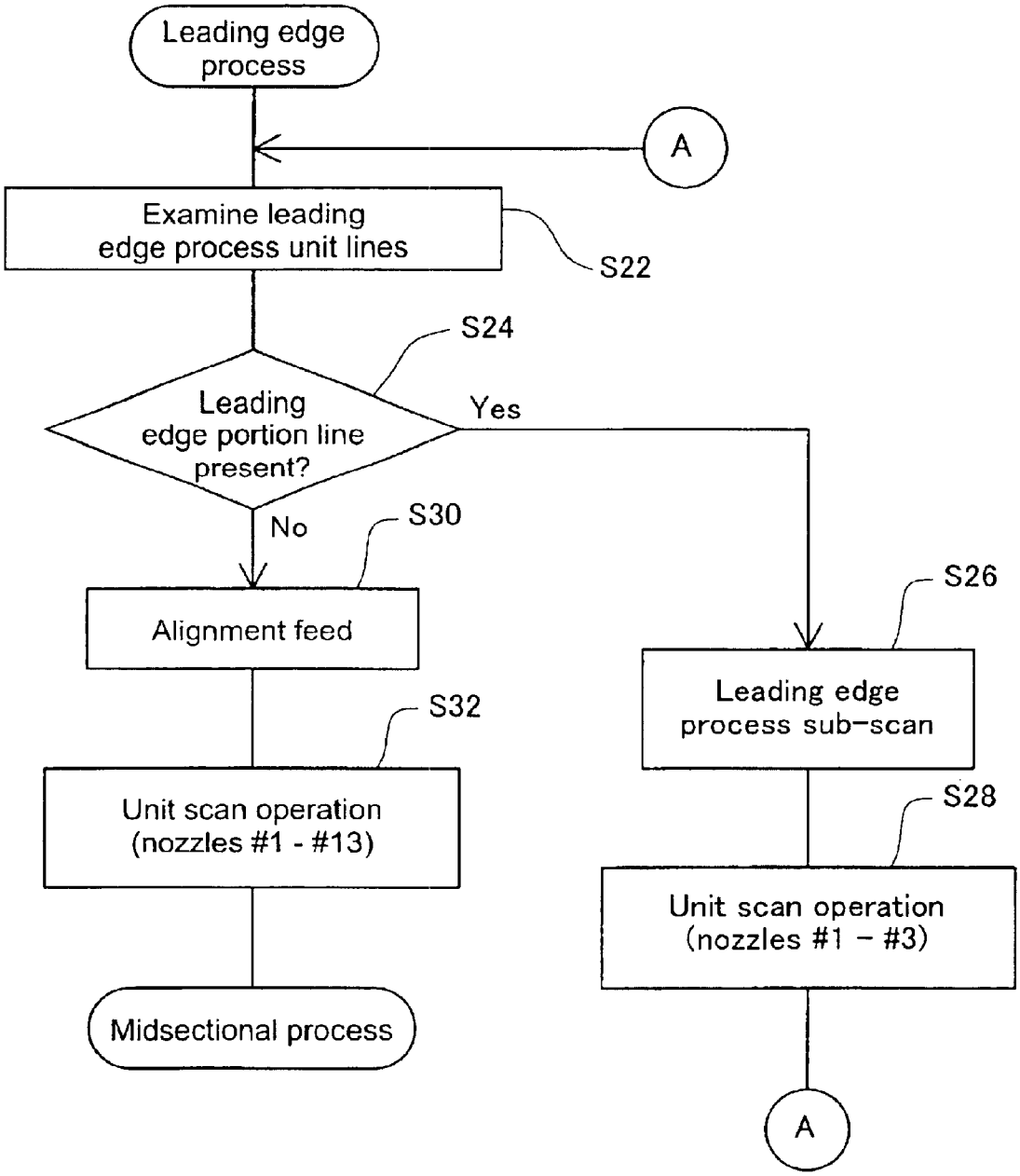
FIG. 12 is a flow chart illustrating the steps in a leading edge process.
Figure 13:
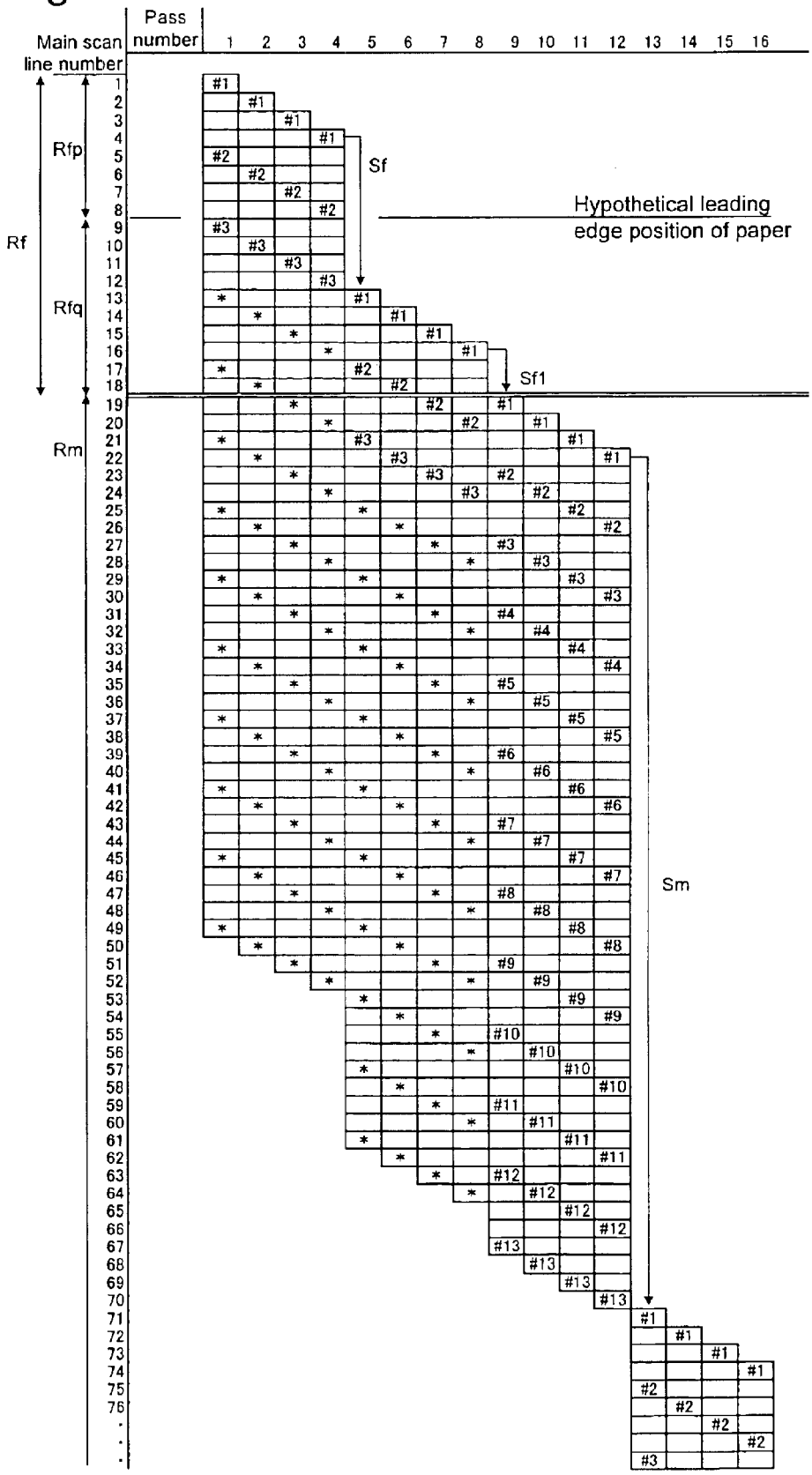
FIG. 13 is an illustration showing the manner of recording graphics data areas corresponding to the leading edge portion and midsectional portion of the printing paper.

FIG. 12 is a flow chart illustrating the steps in the leading edge process. FIG. 13 is an illustration showing the manner of recording graphics data areas corresponding to the leading edge portion and midsectional portion of the printing paper. In the example of FIG. 13, lines 1–18 constitute the leading edge portion Rf, and lines 19 and below constitute the midsectional portion Rm (see FIG. 6). In FIG. 13, one vertical row corresponds to a single main scan.

In the leading edge process, in Step S22 of FIG. 13, examination is made regarding the kind of main scan lines that would be included in the leading edge process unit lines, on the assumption that a subsequent leading edge process sub-scan has been performed and a unit scan operation has been performed. If, as a result, it is determined in Step S24 that there is a leading edge portion line (refers to a main scan line included in leading edge portion Rf; this convention is followed hereinbelow), in Step S26, a leading edge process sub-scan by feed distance Sf is performed, and in Step S28, a unit scan operation is performed using the downstream recessed portion nozzle group Nr (nozzles #1–#3). In the example of FIG. 13, printing up to the eighth pass is executed according to this routine.

In the leading edge process, in the event that a leading edge portion line is included among unit lines or a unit band recorded by means of implementing a predetermined sub-scan and unit scan operation, subsequent performance of which is under consideration, it is concluded that the main scan line of leading edge of the unit lines or unit band is situated in leading edge portion Rf. In the event that a leading edge portion line would not be included among unit lines or a unit band, it is concluded that the main scan line of the leading edge of the unit lines or unit band is situated in midsectional portion Rm.

If, on the other hand, in Step S24 it is determined that there is no leading edge portion line among subsequent leading edge process unit lines, in Step S30, alignment feed by a feed distance Sf1 is performed. This alignment feed is performed in such a way that the main scan line at the leading edge of the midsectional process unit band moves to a relative position aligned with the main scan line at the upper edge of the midsectional portion. Subsequently, in Step S32, a unit scan operation is performed using all nozzles of nozzles #1–#13, whereupon the system transitions to the midsectional process. In the example of FIG. 13, the sub-scan feed coming after the pass 8 represents the alignment feed of Step 530. In the example of FIG. 13, the feed distance Sf1 of the alignment feed is 3 dots. The unit scan operation that includes passes 9–12 represents the unit scan operation of Step S32. The main scan line of the trailing edge of leading edge portion Rf(in the example of FIG. 13, line 18) corresponds to the "main scan line situated a predetermined distance from the leading edge of the printing medium" recited in the claims. This transition from the leading edge process to the midsectional process is executed by means of transition portion 41*a*1 of leading edge processing portion 41*a* (see FIG. 3).

In the example of FIG. 13, lines 19–24 are passed over by two nozzles in main scans during printing. With regards to the main scan lines passed over by two or more nozzles in this way during printing, in this embodiment, dots are recorded by the last nozzle to pass over the main scan line. Accordingly, in the example of FIG. 13, lines 19–24 are not recorded during passes 5–8, but rather recorded during passes 9–12.

In this embodiment, an image is recorded up to the leading edge of the printing paper, with no margin. In this embodiment, among main scan lines to have dots recorded thereon by nozzles on print head 28, dots can be recorded on main scan lines without gaps, beginning at the line situated at the upstream edge in the sub-scanning direction (in the example of FIG. 13, line 1). Thus, if recording of dots commences with printing paper P positioned with respect to print head 28 such that the aforementioned line 1 is situated just at leading edge Pf of printing paper P, theoretically, an image can be recorded right up to the leading edge of the printing paper. However, feed distance error sometimes occurs during sub-scan feeds. Also, in some instances, an ejected ink drop may deviate from its proper direction due to print head manufacturing error or the like. It is preferable to avoid creating a margin at the leading edge of the printing paper, even in the event that an ink drop is deposited away from the proper location on the printing paper for such reasons. Accordingly, in this embodiment, graphics data D used for printing is established beginning at line 1, which of main scan lines to have dots recorded thereon by nozzles on print head 28, is located at the upstream edge in the sub-scanning direction; while printing commences with the leading edge of printing paper P situated at the location of the ninth main scan line from the upstream edge in the sub-scanning direction. Accordingly, as shown in FIG. 13, the hypothetical location of printing paper leading edge Pf with respect to main scan lines at the outset of printing is the location of the ninth main scan line from the upstream edge in the sub-scanning direction.

As noted, at the outset of printing, the leading edge Pf of printing paper P is situated at the location of the ninth main scan line from the upstream edge in the sub-scanning direction, among main scan lines to have dots recorded thereon by nozzles on print head 28. That is, described with reference to FIG. 1, the main scan line at the leading edge of printing paper is positioned directly below nozzle #3 (see FIG. 13). Graphics data is provided for the range indicated by the broken lines in FIG. 1 (directly below nozzle #1). Accordingly, where printing is commenced from this state, it would be expected that the uppermost main scan line of the printable area (in FIG. 13, line 1) would be recorded by nozzle #1, but at this point printing paper P is not yet positioned below nozzle #1, as illustrated in FIG. 1. Accordingly, where printing paper is being advanced properly by upstream paper feed rollers 25*a*, 25*b*, the ink drop Ip ejected from nozzle #1 will descend into downstream recessed portion 26*r*. The same is true of nozzle #2, which would be expected to be record line 5 (see FIG. 13). Where printing paper is being advanced properly by upstream paper feed rollers 25*a*, 25*b*, ink drops ejected by nozzle #1 and nozzle #2 will not be deposited on printing paper P until pass 4 (see FIG. 1).

However, in the event that for some reason printing paper P is advanced by more than the normal feed distance, at the outset of printing the leading edge of printing paper P may in some instances now be situated at the location of lines 1–8 of the printable area (see FIG. 13 and FIG. 1). In this embodiment, since, in such instances as well, ink drops Ip are ejected onto those main scan lines from nozzles #1 and #2, the image can be recorded at the leading edge of printing paper P so that no margin is produced. That is, even if printing paper P is advanced by more than the normal feed distance, provided that the excess feed distance does not exceed 8 lines, the leading edge of printing paper P will be within the range of graphics data indicated by the broken lines in FIG. 1, so no margin will be produced at the leading edge of printing paper P.

Conversely, it is conceivable that for some reason printing paper P will be advanced by less than the normal feed distance. In such an instance, the printing paper will not be present at the normal position where the printing paper should be, resulting in ink drops Ip being deposited on underlying structures. However, as shown in FIG. 13, in this embodiment, the ten lines beginning from the hypothetical leading edge of the paper (i.e. lines 9–18) are recorded by nozzles #1–#3. The downstream recessed portion 26*r* is disposed below these nozzles, and in the event that ink drops Ip fail to be deposited on printing paper P, the ink drops will descend into downstream recessed portion 26*r* and be absorbed by absorbent member 27. Accordingly, the upper face of platen 26 does not become soiled by ink drops Ip, and will not subsequently soil the printing paper P. That is, in this embodiment, even if the leading edge Pf of printing paper P is situated back from the hypothetical leading edge position, as long as the deviation from the hypothetical leading edge position does not exceed ten lines, the upper face of platen 26 will not become soiled by ink drops Ip, and will not subsequently soil the printing paper P.

In preferred practice, printing paper P is sub-scanned while being retained by two sets of rollers, namely, upstream paper feed rollers 25*a*, 25*b* and downstream paper feed rollers 25*c*, 25*d*. This is because sub-scan feed is more accurate, as compared to the case where paper is sub-scanned while being retained by only one set of rollers. However, when printing the leading edge Pf of the printing paper, printing paper P is sub-scanned while being retained by upstream paper feed rollers 25*a*, 25*b* only (see FIG. 1).

In this embodiment, printing commences with the leading edge Pf of the printing paper situated at the location of the ninth main scan line from the upstream edge in the sub-scanning direction, among main scan lines to have dots recorded thereon by nozzles on print head 28 (see FIG. 1 and FIG. 13). Accordingly, as shown in FIG. 1, during the interval from this position to [a position] at which the paper leading edge Pf is retained by downstream paper feed rollers 25*c*, 25*d*, i.e., during the time at which printing paper advances by distance L31 shown in FIG. 1, printing is executed while sub-scanning by means of upstream paper feed rollers 25*a*, 25*b* only. In this embodiment, as the leading edge process is carried out using only a portion of the downstream nozzles, the interval during which printing is performed while sub-scanning by means of upstream paper feed rollers 25*a*, 25*b* only is relatively brief Thus, the printed result has high picture quality. The above-described arrangement is not limiting, and similar working effects can be achieved by means of other arrangements in which the vicinity of the leading edge Pf of printing paper is printed with nozzles in proximity to the downstream edge in the sub-scanning direction. This is particularly effective where feed precision of upstream sub-scanning drive portion (upstream paper feed rollers 25*a*, 25*b*) is relatively low.

In this embodiment, during the leading edge process, graphics data is recorded serially in units of a leading edge process unit band of width L2; during the midsectional process, graphics data is recorded serially in units of a midsectional process unit band of width L1 (see FIG. 7 and FIG. 8). Therefore, no unrecorded main scan lines are left at the boundary of the upper edge portion and midsectional portion, and the transition from the leading edge process to the midsectional process can be made easily in band units. Additionally, no reverse sub-scan feed is required in order to make the transition from the leading edge process to the midsectional process without leaving any unrecorded main scan lines at the boundary of the upper edge portion and midsectional portion.

In an arrangement such as that of Embodiment 1, by transitioning from a leading edge process to a midsectional process, the number of leading edge process sub-scans, midsectional process sub-scans, and alignment feeds can be minimized when recording the portion of the midsectional portion contacting the upper edge portion. For example, in FIG. 13, where lines 19–24 are recorded during passes 19–24, lines 19–70 of the midsectional portion are recorded in the course of two unit scan operations coming before and after a single alignment sub-scan therebetween. In the arrangement of Embodiment 1, on the other hand, lines 19–70 are recorded in a single unit scan operation during passes 9–12. The leading edge process sub-scan, midsectional process sub-scan, and alignment feed have a larger feed distance than does fine advance by feed distance Sfi or Smi, performed during a unit scan operation (see FIG. 7 and FIG. 8), and thus feed error will be greater as well. Therefore, when printing a given area, there is greater likelihood of depressed quality in the printed result, the greater the number of feeds. In Embodiment 1, since the number of feeds can be minimized, quality of printed results in the portion of the midsectional portion in proximity to the boundary with the leading edge portion can be increased.

(5) Transitioning from Midsectional Process to Trailing Edge Process

Figure 15:
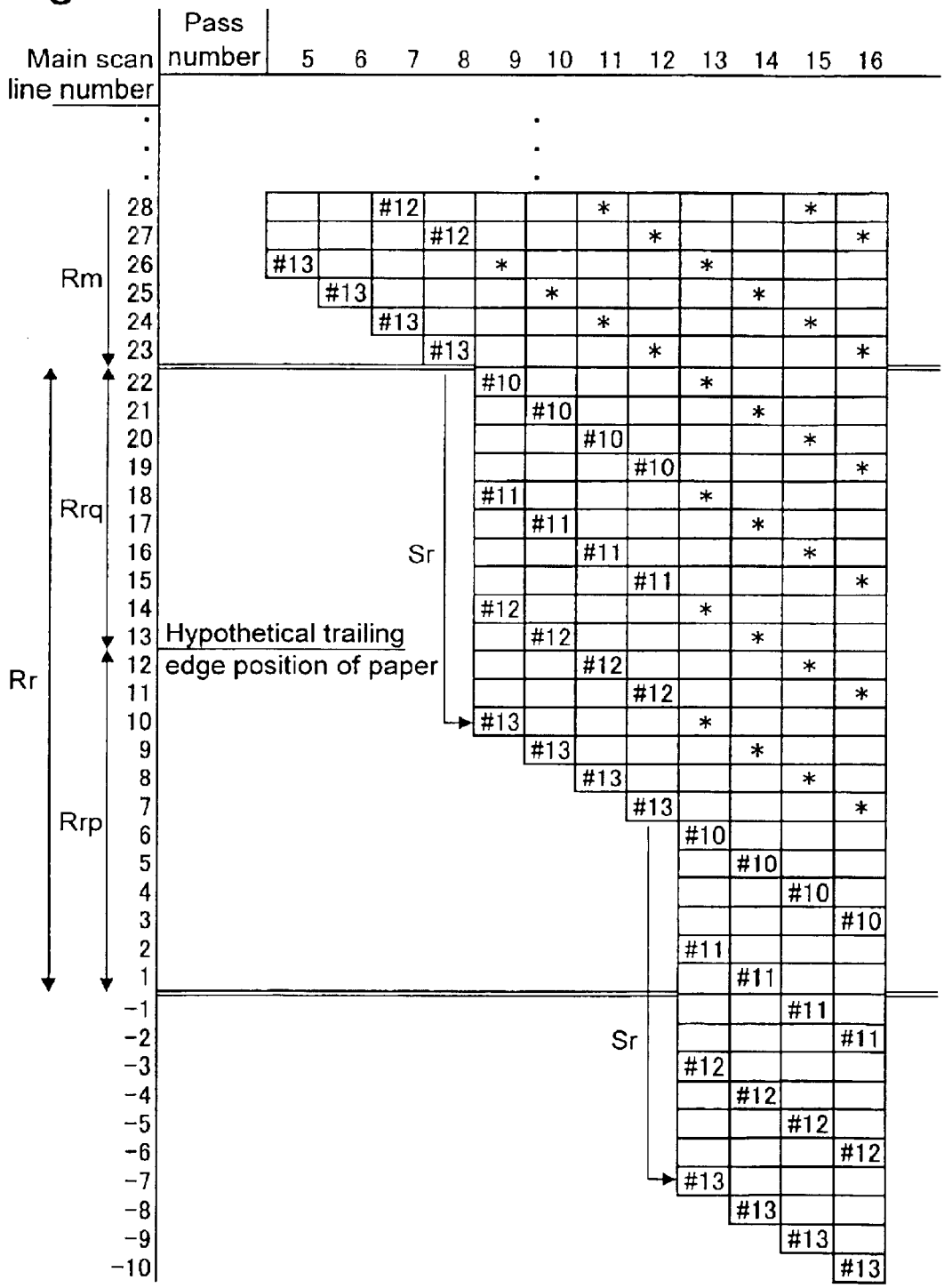
FIG. 15 is an illustration showing the manner of recording graphics data areas corresponding to the midsectional portion and lower edge portion of the printing paper.

FIG. 14 and FIG. 15 are illustrations showing the manner of recording graphics data areas corresponding to the mid-sectional portion and lower edge portion of the printing paper. In this embodiment, an image is recorded using the 11th and upper main scan lines from the downstream edge in the sub-scanning direction, among main scan lines able to have dots recorded thereon by nozzles on print head 28. FIG. 14 and FIG. 15 show, at left in the drawings, numbers assigned to main scan lines, with the 11th main scan line from the downstream edge in the sub-scanning direction being designated as line 1, and moving from there towards the leading edge of the printing paper. The number for each pass, shown at the top, is simply a number assigned for convenience, and does not represent the actual number of passes since the outset of printing.

Figure 16:
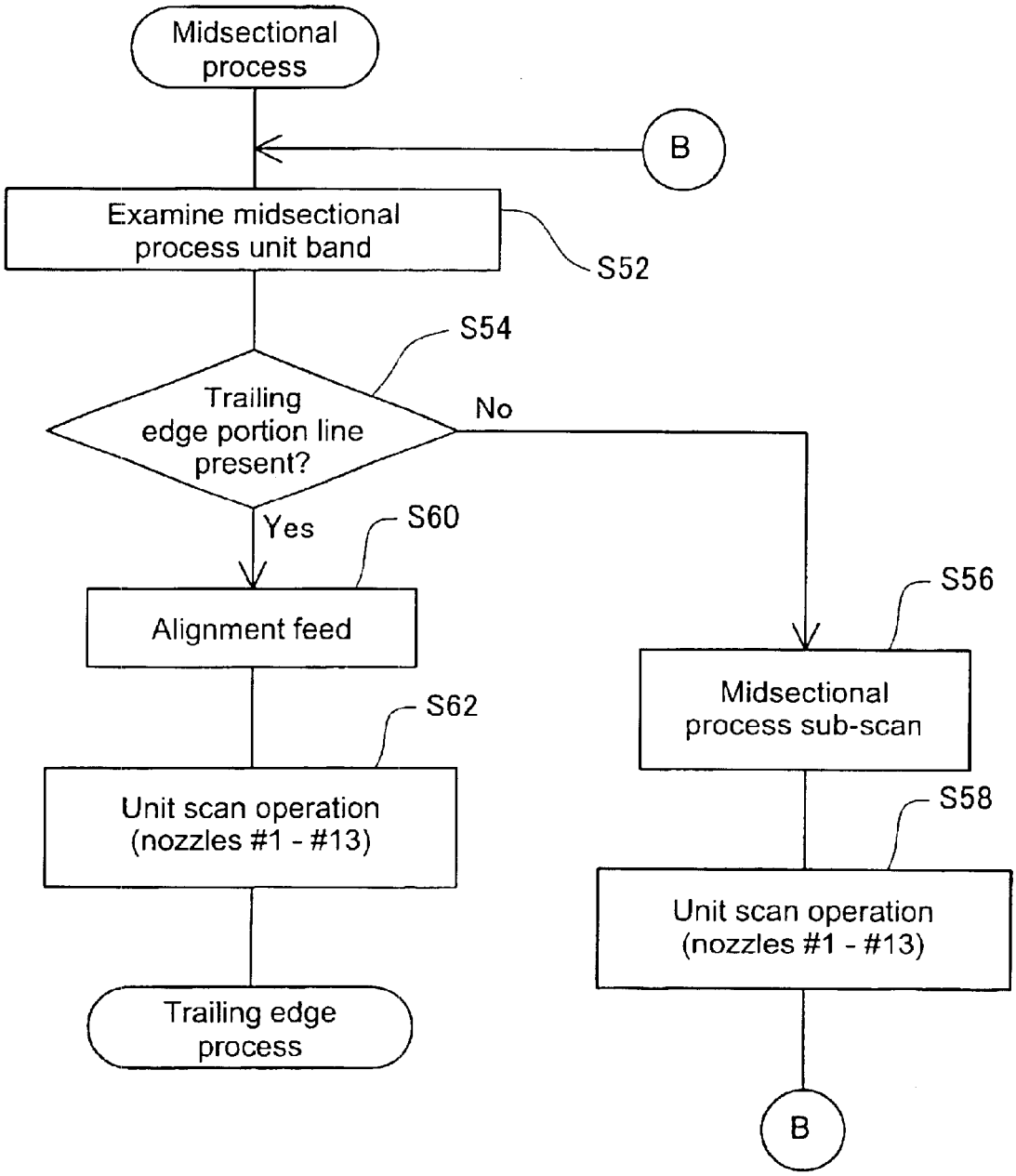
FIG. 16 is a flow chart illustrating the steps in a midsectional process.

FIG. 16 is a flow chart illustrating the steps in the midsectional process. In the midsectional process, in Step S52, consideration is made regarding the kind of main scan lines that would be included in the midsectional process unit band, on the assumption that a midsectional process sub-scan will be performed subsequently. If, as a result, it is determined in Step S54 that there are no trailing edge portion lines (refers to main scan lines included in the trailing edge portion; this convention is followed hereinbelow), in Step S56, a midsectional process sub-scan is performed, and in Step S58, a unit scan operation is performed using all nozzles of nozzles #1–#13. The routine then returns to Step S52. In FIG. 14 and FIG. 15, printing is executed according to this routine up to pass 4.

That is, in the midsectional process, Step S56 and Step S58 will be repeated, and the midsectional process executed, as long as no main scan line of lower edge portion is included in the midsectional process unit band when the subsequent midsectional process sub-scan has been performed.

In the midsectional process, in the event that a trailing edge portion line is included in unit lines or a unit band recorded by means of executing a predetermined sub-scan and subsequent unit scan operation, subsequent performance of which is under consideration, it is concluded that the main scan line of the lower edge of the unit lines or unit band under consideration is situated in lower edge portion Rr. In the event that a trailing edge portion line is not included among unit lines or a unit band, it is concluded that the main scan line of the lower edge of the unit lines or unit band is situated in midsectional portion Rm.

In Step S54, if it is determined that there is a trailing edge portion line, in Step S60, alignment feed by a feed distance Sm 1 is performed. By means of this alignment feed, the printing paper is positioned with the main scan line at the lower edge of the midsectional process unit band, when a unit scan operation has subsequently been performed one time using nozzles #1–#13, situated at a relative position aligned with the main scan line at the lower edge of midsectional portion Rm. Subsequently, in Step S62, a unit scan operation is performed using all nozzles of nozzles #1–#13, whereupon the system transitions to the trailing edge process. In the example of FIG. 14 and FIG. 15, the sub-scan coming after the pass 4 represents the sub-scan performed in Step S60. Here, the feed distance Sm1 of the sub-scan is 12 dots. The unit scan operation that includes passes 5–8 represents the unit scan operation performed in Step S62. The main scan line of the trailing edge of midsectional portion Rm (in the example of FIG. 14 and FIG. 15, line 23) corresponds to the "main scan line situated a predetermined distance from the is trailing edge of the printing medium" recited in the claims.

In the example of FIG. 14 and FIG. 15, lines 38–47 are passed over by two nozzles in main scans during printing. With regards to main scan lines passed over by two or more nozzles in this way during printing, in this embodiment, dots are recorded by the last nozzle to pass over the main scan line. Accordingly, in the example of FIG. 14 and FIG. 15, lines 38–47 are not recorded during passes 1-4, but rather recorded during passes 5–8. This transition from the mid-sectional process to the trailing edge process is executed by means of transition portion **41*b*1 of midsectional processing portion 41*b* (see FIG. 3**).

In this embodiment, an image is recorded with no margin at the trailing edge, in the same manner as with the leading edge. As noted, in this embodiment, an image is recorded using the 11th and subsequent main scan lines from the downstream edge in the sub-scanning direction, among main scan lines able to have dots recorded thereon by nozzles on print head 28. Further, in consideration of the possibility that error in feed distance may occur during sub-scanning, a relationship between graphics data and hypothetical position on the printing paper is established such that, if sub-scanning is performed properly, twelve lines (lines 1–12 in FIG. 15) are recorded beyond the trailing edge of the printing paper. Accordingly, the hypothetical position of the printing paper trailing edge with respect to main scan lines at completion of printing is the position of line 13, as shown in FIG. 15.

When printing of the trailing edge portion of printing paper P concludes in FIG. 9 (pass 16 in FIG. 15), the trailing edge Pr of printing paper P is situated at a location one line downstream (i.e., upward in FIG. 15) from nozzle #8 (see FIG. 9). Graphics data has been provided up to the range indicated by the broken lines in FIG. 9 (two lines upstream from the line directly below nozzle #10). Accordingly, if dots are recorded in the final pass 16 in this state, ink drops Ip ejected from nozzles #10–#13 will descend into upstream recessed portion **26*f***.

However, in the event that for some reason printing paper P is advanced by less than the normal feed distance, at completion of printing the trailing edge of printing paper P may in some instances now be situated at the location of lines 12–1 of FIG. 15. In this embodiment, since, in such instances as well, ink drops Ip are ejected onto those main scan lines from nozzles #10–#13, the image can be recorded at the leading edge of printing paper P so that no margin is produced. That is, even if printing paper P is advanced by less than the normal feed distance, provided that the feed distance deficit does not exceed 12 lines (lines 1–12 of FIG. 15), the trailing edge of printing paper P will be within the range of graphics data indicated by the broken lines in FIG. 9, so no margin will be produced at the trailing edge of printing paper P.

The ten lines above the hypothetical trailing edge location of the paper (in FIG. 15, lines 13–22) are recorded by nozzles #10–#13. Accordingly, in the event that for some reason printing paper P is advanced by more than the normal feed distance, ejected ink drops Ip will descend into upstream recessed portion **26*f*, and will not be deposited on the upper face of platen 26**.

In this embodiment, the final main scan lines on the printing paper is recorded and printing concluded with the trailing edge Pf of the printing paper situated at a location one dot upstream from nozzle #8 of print head 28 (i.e., in FIG. 15, the location of line 13). Accordingly, as shown in FIG. 9, during the interval that printing paper P advances by distance L41, i.e. from the time that the trailing edge Pr of printing paper P separates from upstream feed rollers 25*a*, 25*b* until reaching the location of line 13, printing is executed while sub-scanning is performed by downstream feed rollers 25*c*, 25*d* only. In this embodiment, as the trailing edge process is carried out using only a portion of the upstream nozzles, the interval during which printing is performed while sub-scanning by means of downstream feed rollers 25*c*, 25*d* only is relatively brief. Thus, the printed result has high picture quality. In particular, downstream feed roller 25*d* is a roller of toothed gear configuration, and the combination of downstream feed rollers 25*c*, 25*d* has lower feed accuracy than do the upstream feed rollers 25*a*, 25*b*. Thus, the fact that the interval during which printing is performed while sub-scanning by means of downstream feed rollers 25*c*, 25*d* only is relatively brief is highly effective in terms of improving quality of printed results. The above-described arrangement is not limiting, and similar working effects can be achieved by means of other arrangements in which the vicinity of the trailing edge Pr of printing paper is printed with nozzles in proximity to the upstream edge in the sub-scanning direction. This is particularly effective where feed precision of the downstream sub-scanning drive portion (downstream paper feed rollers 25*c*, 25*d*) is relatively low.

In this embodiment, in the midsectional process, graphics data is recorded serially in units of a midsectional process unit band of width L1; during the trailing edge process, graphics data is recorded serially in units of a trailing edge process unit band of width L3 (see FIG. 7 and FIG. 11). Therefore, no unrecorded main scan lines are left at the boundary of the midsectional portion and trailing edge portion, and the transition from the midsectional process to the trailing edge process can be made easily in band units. Additionally, no reverse sub-scan feed is required in order to make the transition from the midsectional process to the trailing edge process without leaving any unrecorded main scan lines at the boundary of the midsectional portion and lower edge portion.

(6) Printing of Left and Right Edge Portions

Figure 17:
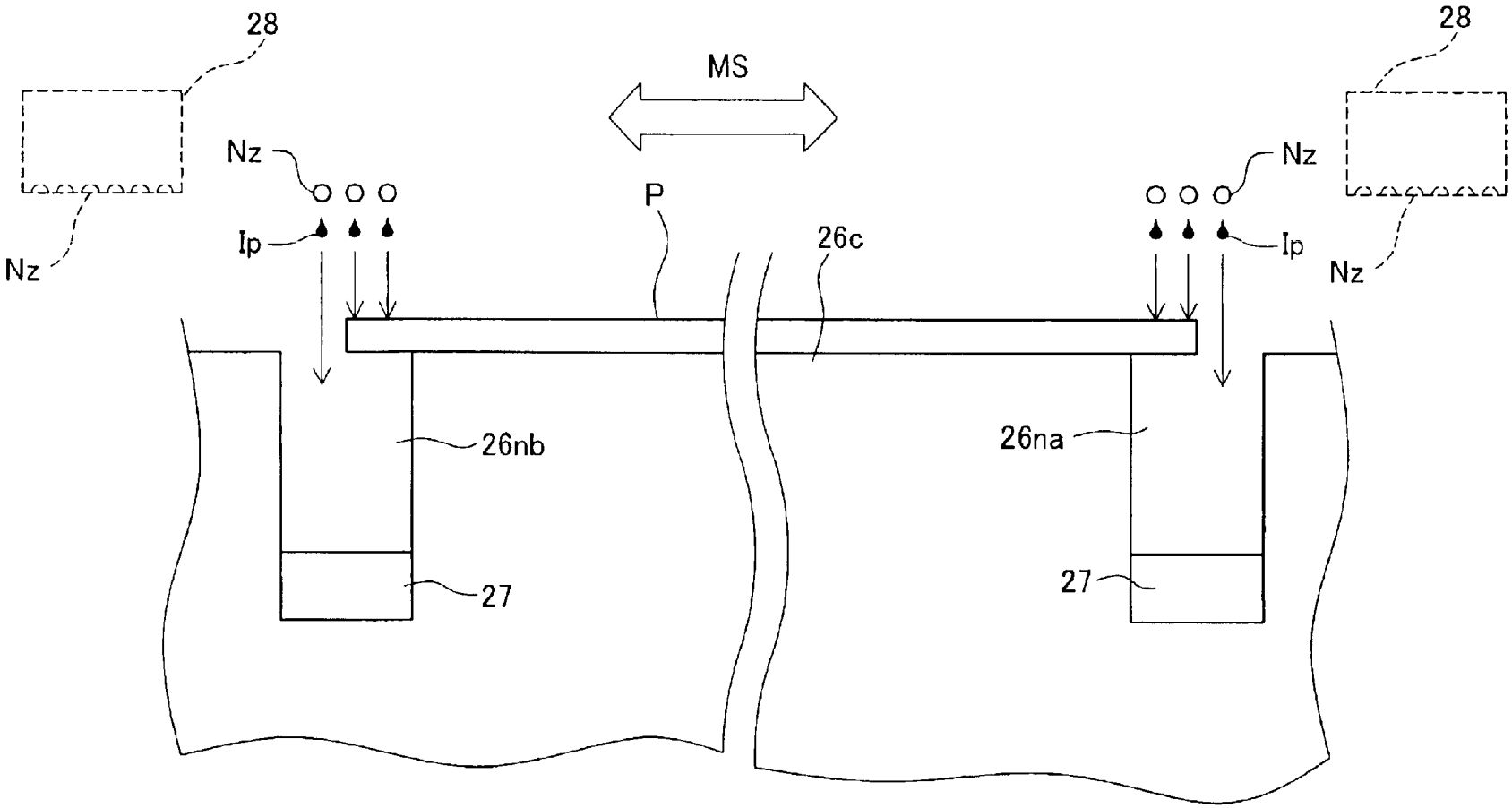
FIG. 17 is an illustration showing printing of left and right edge portions of printing paper P.

FIG. 17 is an illustration showing printing of left and right edge portions of printing paper P. In this embodiment, throughout recording of an image onto printing paper P (including the leading edge process and trailing edge process), printing is performed in such a way that no margin is produced at the left and right edges of the printing paper P. In main scans performed during this time, the print head 28, in relation to a first edge of the paper, is advanced to a position outside the printing paper P with all of the nozzles situated past the first edge, and in relation to the other edge is similarly advanced to a position outside the printing paper P with all of the nozzles situated past this other edge. Ink drops are ejected from nozzles Nz in accordance with graphics data D, not only when nozzles Nz are positioned over the printing paper P, but additionally when nozzles Nz are positioned beyond the edges of the printing paper P, and over the left recessed portion 26*a* and right recessed portion 26*b*. The image recording area for graphics data D (extended area R) has width extending past the left and right edges of printing paper P, but less than the space between the outer side walls of left recessed portion 26*a* and right recessed portion 26*b*. Thus, even with the nozzles positioned over left recessed portion 26*a* and right recessed portion 26*b* to the outside of printing paper P, ink drops can be ejected in accordance with graphics data D.

By performing printing in this manner, an image can be reproduced without producing margins at the left and right edges of printing paper P, even if printing paper P should be somewhat out of line in the main scanning direction. Additionally, since the nozzles that print the side edges of the printing paper are positioned over left recessed portion 26*a* and right recessed portion 26*b*, even if ink drops should miss the printing paper P, the ink drops will be deposited in the left recessed portion 26*a* or right recessed portion 26*b*, rather than being deposited on the center portion 26*c* of the platen 26. Accordingly, the printing paper P will not be soiled by drops of ink deposited on the center portion 26*c* of the platen 26.

C. Embodiment 2

Figure 18:
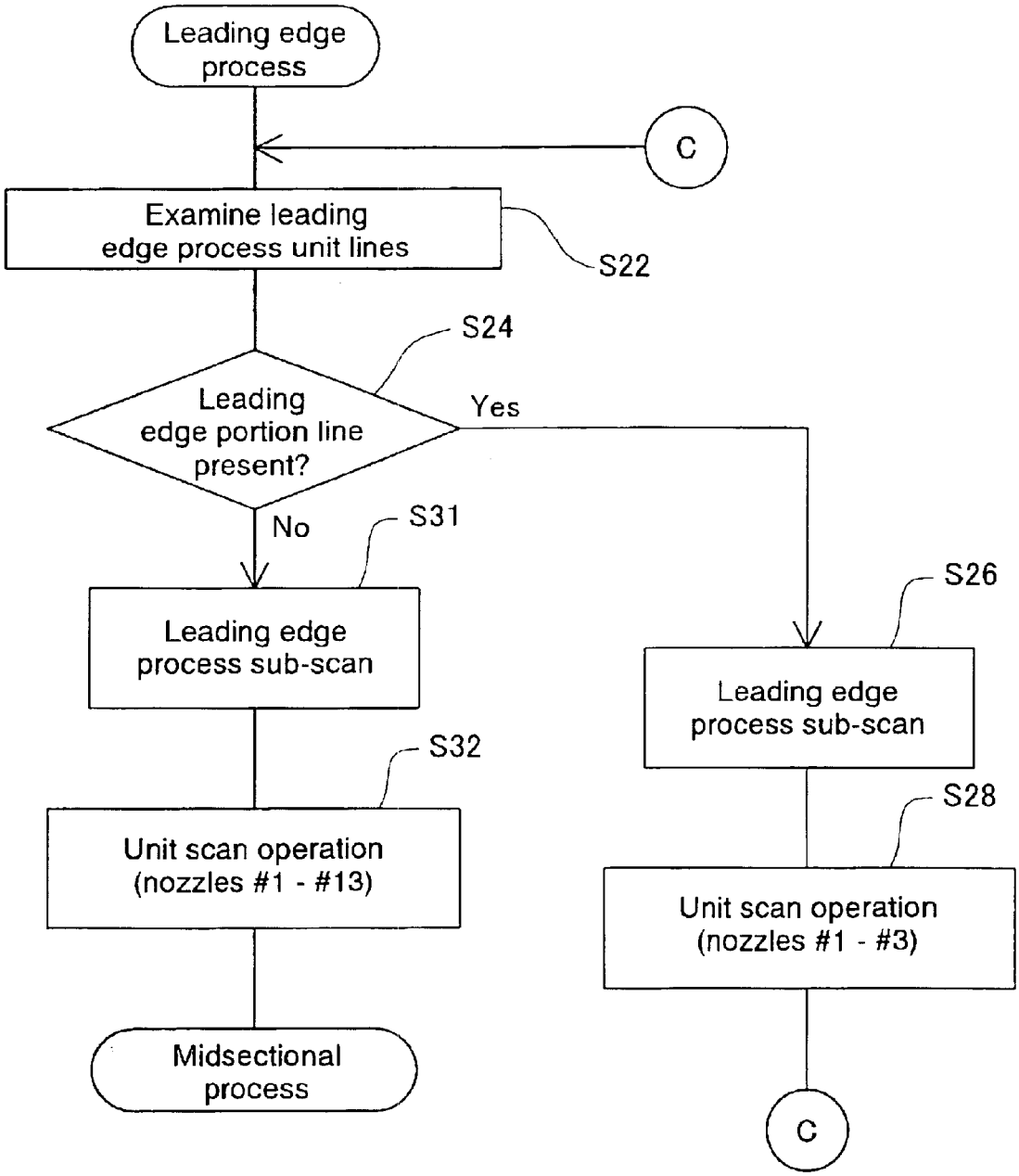
FIG. 18 is a flow chart illustrating the steps in a leading edge process in a second embodiment.

FIG. 18 is a flow chart illustrating the steps in a leading edge process in a second embodiment. In the process of the first embodiment shown in FIG. 12, if no leading edge portion line is present among the leading edge process unit lines (Step S24), the alignment feed of Step S30 is performed (refer to the sub-scan feed after pass 8 in FIG. 13). In Embodiment 2, however, when transitioning from the leading edge process to the midsectional process, in Step S31, leading edge process sub-scanning is performed in the same manner as previously, without performing alignment feed. In other respects, the hardware arrangement and process steps are the same as in Embodiment 1.

Figure 19:
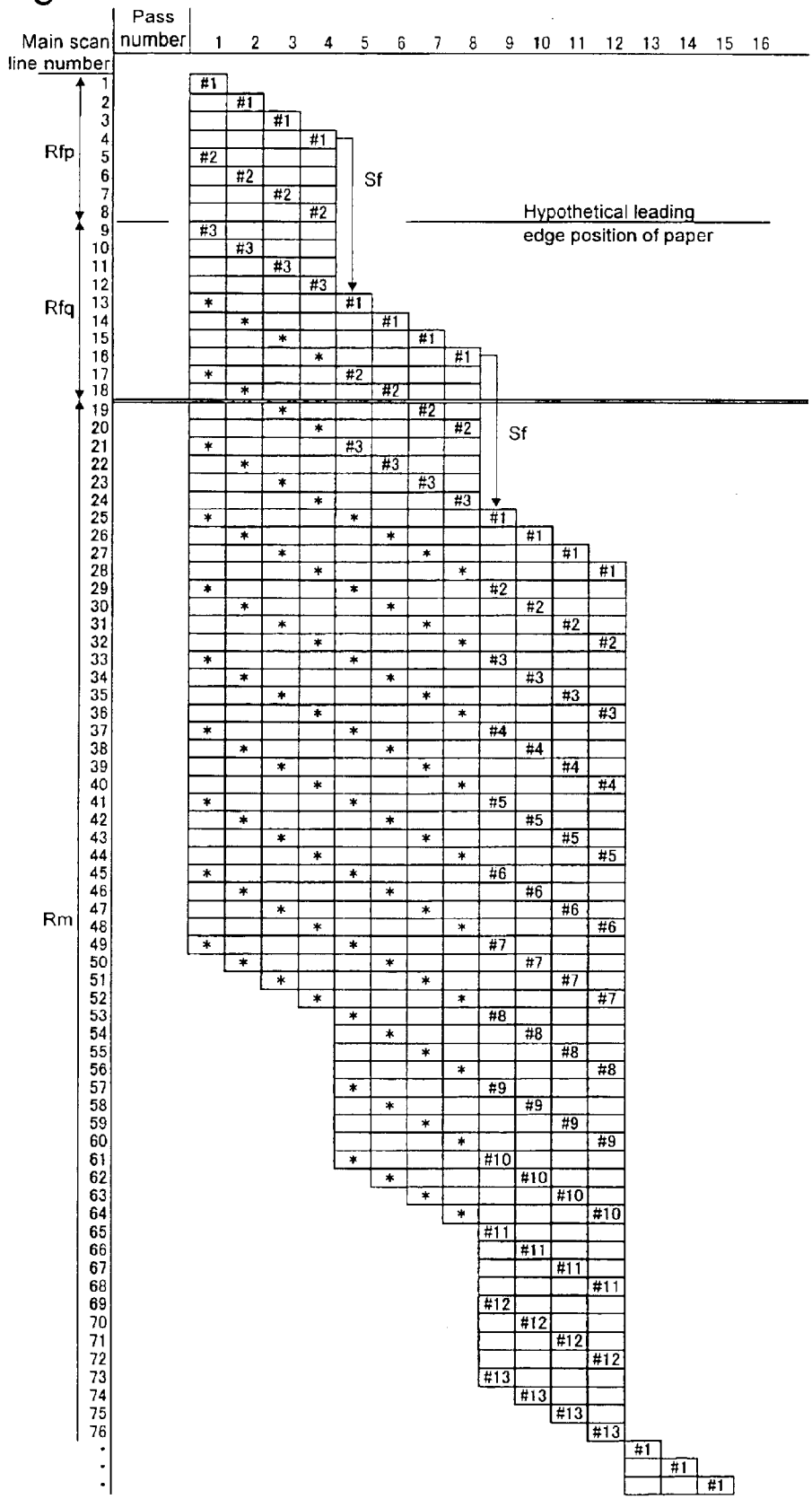
FIG. 19 is an illustration showing the manner of recording graphics data areas corresponding to the leading edge portion and midsectional portion of the printing paper in the second embodiment.

FIG. 19 is an illustration showing the manner of recording graphics data areas corresponding to the leading edge portion and midsectional portion of the printing paper in the second embodiment. Up to pass 8, the process is carried out in the same manner as in FIG. 13 of Embodiment 1. Subsequent to pass 8, in Step S24 in FIG. 18, it is determined that there is no leading edge portion line in the leading edge process unit lines when the next leading edge process sub-scan was performed. Thereupon, in Step S31, a leading edge process sub-scan of feed distance Sf is performed, and in Step S32 a unit scan operation is performed using nozzles #1–#13. The unit scan operation that includes passes 9–12 represents the unit scan operation of Step S32. By means of this arrangement as well, efficient transition from the leading edge process to the midsectional process is possible. With this arrangement, nozzles do not pass multiple times over main scan lines in proximity to the boundary of midsectional portion Rm and leading edge portion Rf. Thus, dots are efficiently recorded on main scan lines.

D. Embodiment 3

In Embodiment 1 and Embodiment 2, main scan line pitch is smaller than nozzle pitch. In Embodiment 3, however, main scan line pitch and nozzle pitch are equal. That is, nozzle pitch is 1 dot. In each of the upper edge process, midsectional process and trailing edge process, the unit scan operation is composed of a single main scan. In other respects, the hardware arrangement and printing process steps are the same as in Embodiment 1.

Figure 20:
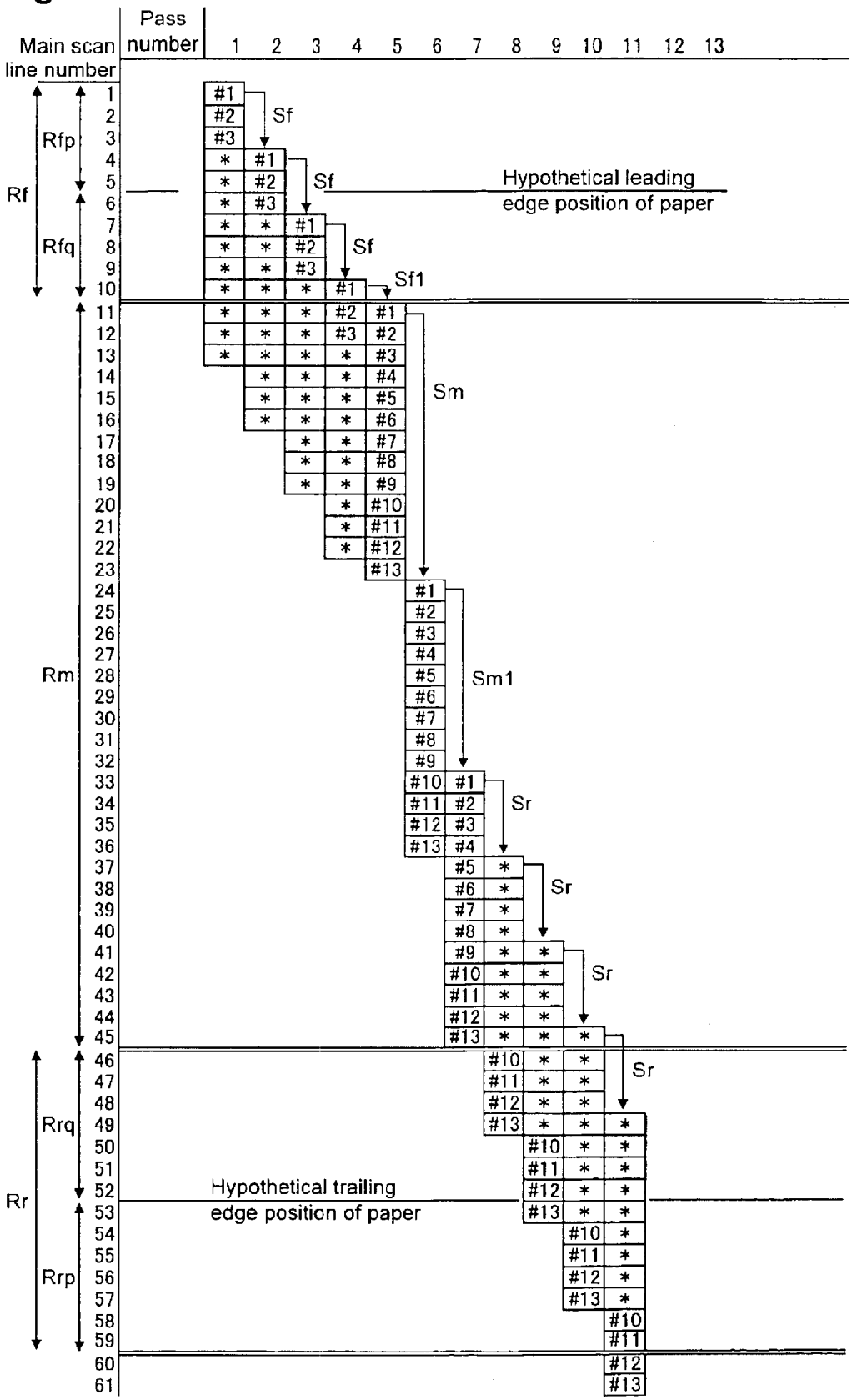
FIG. 20 is an illustration showing the manner of recording graphics data areas corresponding to the leading edge portion and midsectional portion of the printing paper.

FIG. 20 is an illustration showing the manner of recording graphics data areas corresponding to the leading edge portion and midsectional portion of the printing paper. In the example of FIG. 20, the outside leading edge portion Rfp of the recording area consists of lines 1–5, and the inside leading edge portion Rfq of lines 6–10. The midsectional portion Rm consists of lines 11–45. The inside trailing edge portion Rrq consists of lines 46–52, and the outside trailing edge portion Rrp of lines 53–59.

In the example of FIG. 20, the upper edge process consists of passes up to pass 4. The sub-scan performed after pass 4 represents the alignment feed of Step S30 in FIG. 12. The sub-scan performed after pass 5, and pass 6 together constitute the midsectional process. The sub-scan performed after pass 6 represents the alignment feed of Step S60 in FIG. 16, and pass 7 represents the unit scan operation of Step S62. The subsequent pass and sub-scan constitute the trailing edge process.

The main scan line at the trailing edge of leading edge portion Rf (line 10 in FIG. 20) corresponds to the "main scan line situated a predetermined distance from the leading edge of the printing medium" recited in the claims. The main scan line at the trailing edge of midsectional portion Rm (line 45 in FIG. 20) corresponds to the "main scan line situated a predetermined distance from the trailing edge of the printing medium" recited in the claims.

Where printing is conducted with main scan line pitch and nozzle pitch that are equal to one another as in Embodiment 3, for a given print head, a given area can be printed with fewer main scan lines, as compared to the case where main scan line pitch is smaller than nozzle pitch. Thus, printing can be carried out more rapidly.

E. Variant Examples

The invention is not limited to the examples and embodiments described hereinabove, and may be reduced to practice in various ways without departing from the scope and spirit thereof. For example, the following, non-limiting, variants are possible.

E1. Variant Example 1

Figure 21:
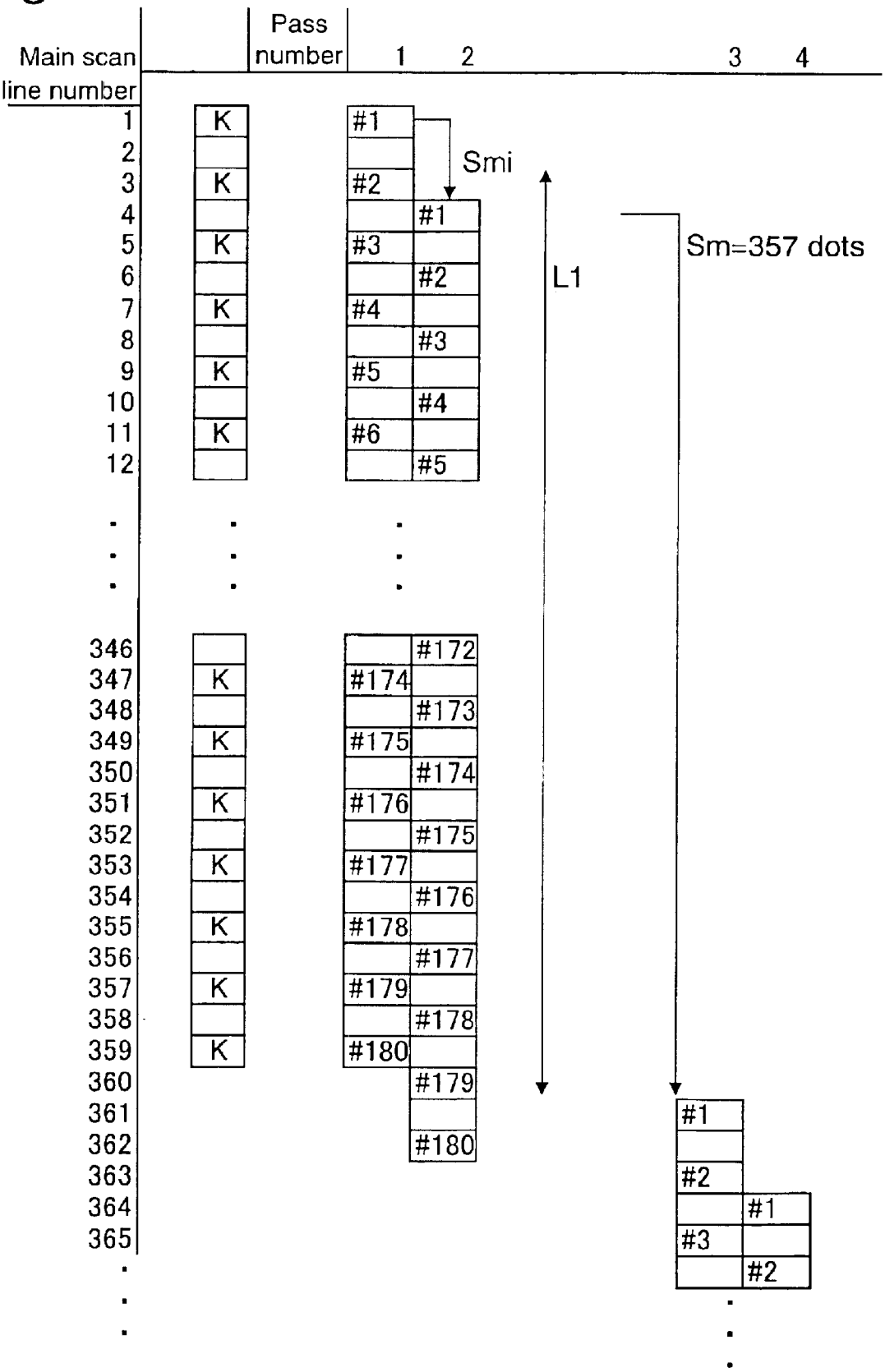
FIG. 21 is an illustration showing a print head and midsectional process of another example.

FIG. 21 is an illustration showing a print head and midsectional process of another example. In this example, 180 nozzles are provided for each color, and printing is carried out at a main scan pitch equivalent to ½ the nozzle pitch. That is, nozzle pitch is 2 dots. In this example, the unit scan operation is composed of two main scans, and a single 3-dot sub-scan performed between these. The number L1 of main scan lines recorded without a gap in the sub-scanning direction during a single unit scan operation is 358 dots. Feed distance Sm of the midsectional process sub-scan performed between unit scan operations is 357 dots.

Main scan line pitch may take any value, provided it is smaller than nozzle pitch. Thus, where nozzle pitch is expressed in terms of main scan line pitch, nozzle pitch may have a value of 2 dots or 4 dots, or some other value such as 6 dots or 8 dots. That is, it is sufficient for the "dots" of nozzle pitch k to be an integer equal to 2 or greater. In other words, it is preferable for main scan line pitch to be a fraction having the nozzle pitch integer as the denominator and 1 as the numerator.

Feed distance of the sub-scan performed during a unit scan operation is not limited to 1 dot as described in Embodiment 1, and may instead consist of 3 dots, as in FIG. 21, or of some other feed distance. However, in preferred practice, nozzle pitch and feed distance of the sub-scan performed during a unit scan operation, each represented in terms of "dots" will be prime from each other.

In Embodiments 1–3, the unit scan operation is the same process in the leading edge process, midsectional process, and trailing edge process. However, different sub-scan feed distances could be employed for unit scan operations during the leading edge process, midsectional process, and trailing edge process. For example, for the leading edge process and trailing edge process, a 1-dot feed distance could be used for sub-scans carried out during unit scan operations, while using a 5-dot feed distance in the midsectional process. Additionally, different sub-scan feed distances could be employed for unit scan operations during the leading edge process and trailing edge process. That is, unit scan operations performed in each of the processes may consist of a second unit scan operation in which one or more main scans are performed to record a plurality of main scan lines that include two or more main scan lines adjacent to one another. In preferred practice, however, the feed distance of sub-scans performed within unit scan operations in the leading or trailing process will be a value equal to or less than the feed distance of sub-scans performed within unit scan operations in the midsectional process. Main scan lines that are "adjacent to one another" herein refers to a condition in which, at completion of printing, no additional row of dots extending the main scanning direction is present between the rows of dots recorded on the respective two main scan lines.

A smaller feed distance of sub-scans within unit scan operations of the leading edge process allows the leading edge of the printing paper to be recorded with nozzles situated further downstream in the sub-scanning direction. It accordingly becomes possible to make the downstream recessed portion narrower, affording a wider area on the platen upper surface to support the printing paper. Similarly, a smaller feed distance of sub-scans within unit scan operations of the trailing edge process allows the trailing edge of the printing paper to be recorded with nozzles situated further upstream in the sub-scanning direction. It accordingly becomes possible to make the upstream recessed portion narrower, affording a wider area on the platen upper surface to support the printing paper.

Additionally, the number of main scans performed within unit scan operations can be varied among the leading edge process, midsectional process, and trailing edge process. For example, where nozzle pitch k is 4 (dots), in the leading edge and trailing edge processes, four main scans could be performed in each unit scan operation, and in the midsectional process, eight main scans performed in the unit scan operation. In the midsectional process, an arrangement whereby pixels in a main scan line are recorded alternately in different main scans is possible. In the unit scan operation of the leading edge process, midsectional process, or trailing edge process, an arrangement whereby a number of main scans which is a multiple n (n is an integer) of the nozzle pitch k is performed to produce the pixels in each main scan line over n main scans is also possible.

In Embodiments 1–3, sub-scanning performed at intervals between unit scan operations is carried out such that, of main scan lines having dots recorded thereon during the unit scan operation just previous, the nozzles at the leading edge of the nozzle rows are positioned at the main scan line situated adjacently behind the main scan line at the trailing edge. However, where the feed distance of the sub-scan during the unit scan operation is greater than 1 dot, sub-scanning is performed such that, of main scan lines having dots recorded thereon during the unit scan operation just previous, the nozzles at the leading edge of the nozzle rows are positioned forward of the main scan line situated at the trailing edge. That is, sub-scanning performed at intervals between unit scan operations can be carried out such that, of main scan lines having dots recorded thereon during the unit scan operation just previous, the nozzles at the leading edge of the nozzle rows are positioned at the main scan line situated adjacently behind the main scan line at the trailing edge of a cluster of main scan lines lined with no gaps in the sub-scanning direction.

In Embodiment 1, main scan lines passed over by two or more nozzles during printing have dots recorded thereon by the last nozzle to pass over the main scan line. However, an arrangement whereby main scan lines passed over by two or more nozzles during printing have dots recorded thereon by the first nozzle to pass over the main scan line is also possible. An arrangement whereby dots are recorded by an nozzle other than the first or last nozzle to pass over the main scan line is also possible. Additionally, an arrangement whereby main scan lines passed over by two or more nozzles are recorded by sharing formation of the pixels of the main scan line among the nozzles.

In Embodiment 1, left recessed portion 26*a* and right recessed portion 26*b* are situated such that with the printing paper P at a predetermined main scanning position, the side edges thereof are located over the centerlines of left recessed portion 26*a* and right recessed portion 26*b*. However, it also possible to situate the left recessed portion 26*a* and right recessed portion 26*b* such that with the printing paper P guided to a predetermined main scanning position by means of guides 29*a*, 29*b*, a first side edge Pa of printing paper P in the main scanning direction is positioned over the opening of left recessed portion 26*a*, and the other side edge Pb is positioned over the opening of right recessed portion 26*b*. Accordingly, they may be disposed such that the side edges of printing paper P are situated inwardly or outwardly from centerlines of left recessed portion 26*a* and right recessed portion 26*b*.

E2. Variant Example 2

Figure 22:
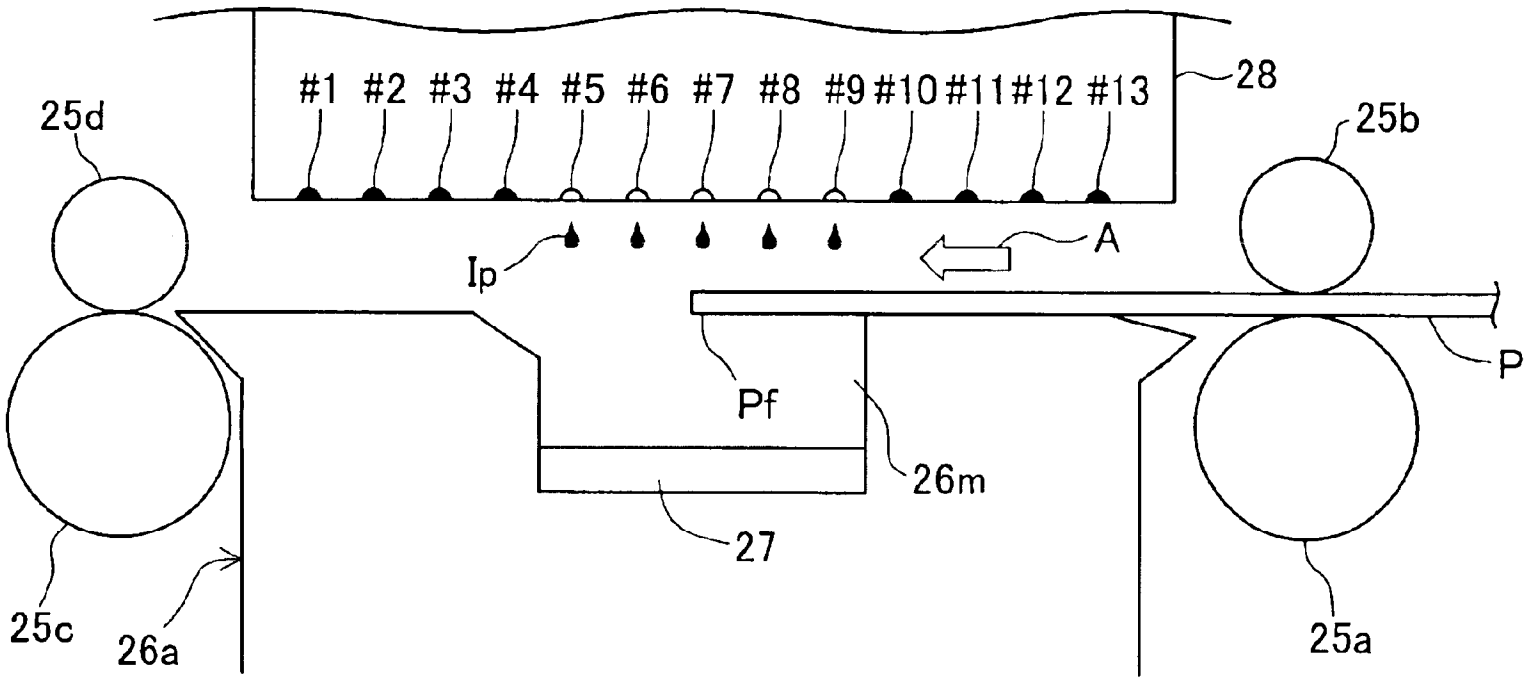
FIG. 22 is a side view of another example of a printing device.

FIG. 22 is a side view of another example of a printing device. In Embodiment 1, the platen is provided with two recesses, namely, an upstream and a downstream. However, an arrangement whereby the platen is provided with only one recessed portion, as shown in FIG. 22, is also possible. With such an arrangement, during the leading edge and trailing edge processes, dots are recorded using only nozzle #5–#9, which are situated facing the recessed portion 26*m*. In the midsectional process, dots are recorded using nozzles #1–#13. With this arrangement as well, dots can be recorded without margins up the edges of the printing paper, without soiling the platen.

In the printing devices of the embodiments described hereinabove, as well as in the printing device shown in FIG. 22, when performing printing at the edge portions of the printing paper, additional nozzles can be employed instead of just the nozzles facing the recessed portion(s). That is, when printing the leading edge of the printing paper, nozzles situated upstream from the recessed portion can be used, in addition to the nozzles facing the recessed portion. When printing the trailing edge of the printing paper, nozzles situated downstream from the recessed portion can be used, in addition to the nozzles facing the recessed portion.

E3. Variant Example 3

In the embodiments hereinabove, the image extends beyond the edges of the printing paper, in the case of Embodiment 1, by 8 lines at the leading edge and by 12 lines at the trailing edge, or in the case of Embodiment 3, by 5 lines at the leading edge and by 7 lines at the trailing edge. However, the size of the image set beyond the edges of the printing paper is not limited to these. For example, the width of the recording area set to the outside of printing paper beyond the leading edge Pf of printing paper P could be equal to ½ the width of downstream recessed portion 26*r*. Similarly, the width of the recording area set to the outside of printing paper beyond the trailing edge Pr of printing paper P could be equal to ½ the width of upstream recessed portion 26*f*.

E4. Variant Example 4

Figure 23:
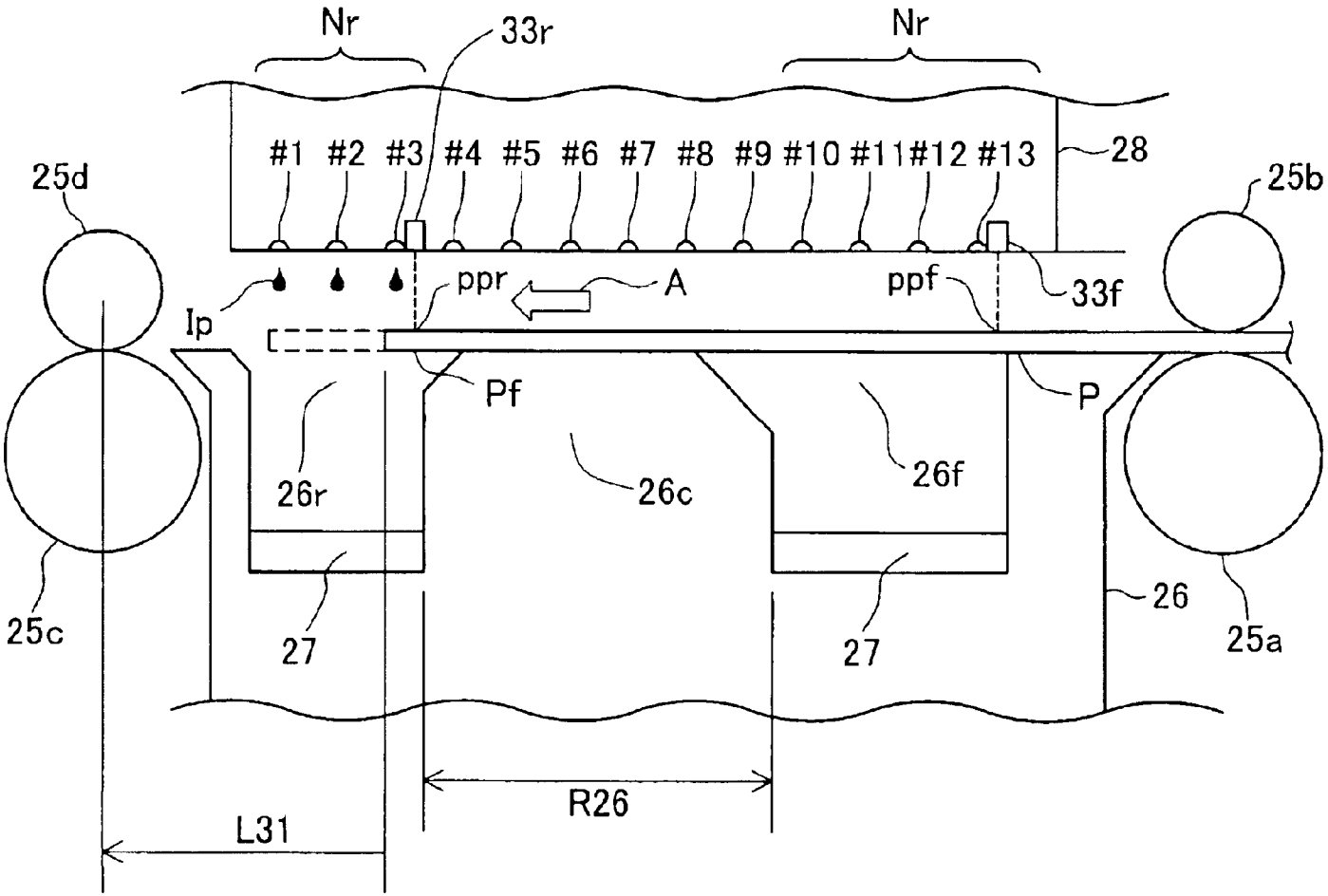
FIG. 23 shows a printing device equipped with a sensor able to sense whether printing paper is present.
Figure 24:
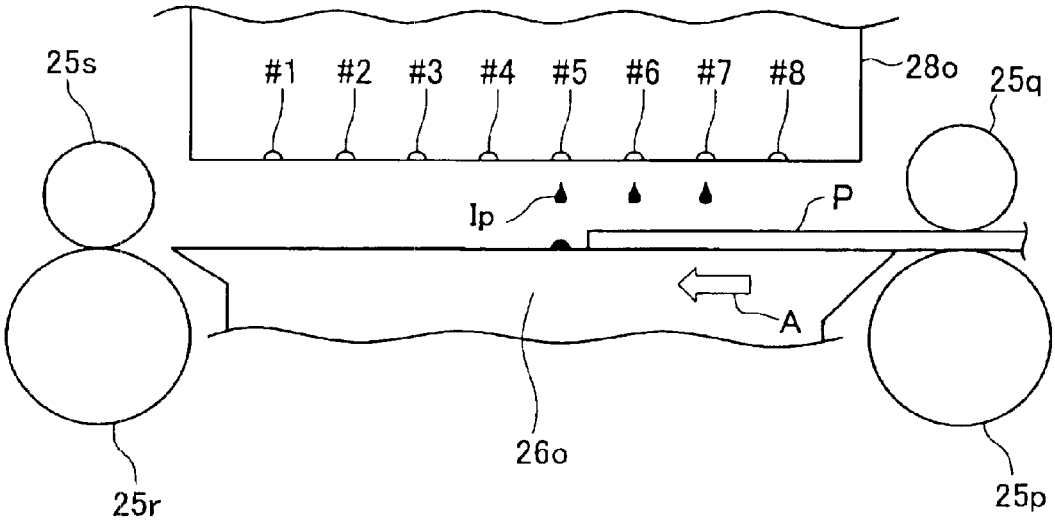
FIG. 24 is a side view showing the area around the print head in a conventional printer.

FIG. 23 shows a printing device equipped with a sensor able to sense whether printing paper is present. The printing device shown in FIG. 23 comprises a photoreflector 33*r* situated at a location on downstream recessed portion 26*r*, between nozzle #3 situated furthest upstream among the nozzles above downstream recessed portion 26*r* and the nozzle #4 which is not situated over downstream recessed portion 26*r*. The printing device additionally comprises another photoreflector 33*f* situated at a location above upstream recessed portion 26*f*, further upstream from the nozzle #13 situated furthest upstream among the nozzles above upstream recessed portion 26*f*.

Photoreflectors 33*r*, 33*f* are provided as integral units each composed of a light-emitting diode 33*d* and a phototransistor 33*t*. Light-emitting diode 33*d* emits light towards a predetermined sensing site, and phototransistor 33*t* receives the reflected light, converting changes in the intensity of the light into changes in an electrical current. CPU 41 of control circuit 40 determines whether portions of the printing paper P are present at the sensing sites (indicated by ppf and ppr in FIG. 23) depending on whether the phototransistors 33*t* have received light reflected from the printing paper P.

In a printing device having such an arrangement, it is possible to detect advancement of the leading edge Pf of the printing paper to location ppr situated above downstream recessed portion 26*r* (i.e. to a location in the sub-scanning direction indicated by the broken line extending downward from photoreflector 33*r* in FIG. 23). Since photoreflector 33*r* is disposed in the location described above, sensing location ppr is a location in proximity to the upstream edge of recessed portion 26*r*. Thus, photoreflector 33*r* is able to detect the leading edge Pf of the printing paper just after the leading edge Pf of the printing paper reaches a point over downstream recessed portion 26*r*. With such an arrangement, once the leading edge Pf of the printing paper has been detected, printing can optionally continue for a predetermined appropriate time interval, and the entire printing process can be initiated through printing by means of the midsectional process from the situation in which the leading edge Pf of the printing paper is set over downstream recessed portion 26*r*. That is, in a printing device of this design, printing can be executed without a leading edge process.

Similarly, in a printing device having such an arrangement, it is possible to detect advancement of the trailing edge Pr of the printing paper to location ppf situated above upstream recessed portion 26*f* (i.e. to a location in the sub-scanning direction indicated by the broken line extending downward from photoreflector 33*f* in FIG. 23). That is, it may be detected that the printing paper is no longer detected at location ppf. Since photoreflector 33*f* is disposed in the location described above, sensing location ppf is a location in proximity to the upstream edge of recessed portion 26*f*. Thus, photoreflector 33*f* is able to detect the trailing edge Pr of the printing paper just after the trailing edge Pr of the printing paper reaches a point over upstream recessed portion 26*f*. With such an arrangement, once the trailing edge Pr of the printing paper has been detected, printing can optionally continue for a predetermined appropriate time interval, and printing by means of the midsectional process subsequently can be concluded with the trailing edge Pr of the printing paper now situated over upstream recessed portion 26*f*, to bring the entire printing process to a conclusion. That is, in a printing device of this design, printing can be executed without a trailing edge process.

From the preceding, it will be apparent that only one process selected from the leading edge and trailing edge processes may be performed as needed. That is, an arrangement whereby, during printing, the midsectional process and trailing edge process are performed without performing the leading edge process, or whereby the leading edge process and midsectional process are performed without performing the trailing edge process, is also possible. Alternatively, an arrangement whereby only the leading edge process is performed throughout the entire printing process, or whereby only the trailing edge process is performed throughout the entire printing process, is also possible. Arrangements wherein the printing device has a plurality of printing modes each including at least one process selected from the leading edge process, midsectional process and trailing edge process are also possible.

In a printing device able to initiate printing after detecting the presence of the leading edge Pf of the printing paper over a recessed portion, even where a leading edge process is performed, the leading edge process may be carried out in the following manner. Specifically, the leading edge process can be performed using not only nozzles situated facing the recessed portion (nozzles #1–#3 in FIG. 23), but also nozzles located upstream from the recessed portion (any of nozzles #4–#13 in FIG. 23).

In Variant Example 4, a printing device having photoreflectors 33*f*, 33*r* on the carriage as sensors for detecting printing paper was described. However, other types of sensors may be employed as sensors for detecting printing paper. That is, other optical sensors may be employed, as may non-contact sensors of types other than optical type, such as sound wave sensors. Contact sensors that detect the presence of printing paper through contact of the printing paper with a certain component may be employed as well. Placement of sensors for detecting printing paper may be that described above, or at other locations on the carriage facing the recessed portions, or at locations not on the carriage, such as on the platen, or on the upstream support portion that supports the printing paper at the upstream end of the print head.

E5. Variant Example 5

In the preceding embodiments, some of the arrangements realized through hardware may instead by substituted by software, and conversely some of the arrangements realized through software may instead by substituted by hardware. For example, some of the functions of CPU 41 (see FIG. 3) could be performed by the computer 90.

A computer program for realizing such functions can be provided in a form recorded on a computer-readable storage medium such as a floppy disk or CD-ROM. The computer 90 reads the computer program from the storage medium and transfers it to an internal memory device or external memory device. Alternatively, the computer program may be provided to the computer 90 from a program supplying device via a communications link. When realizing the functions of the computer program, the computer program stored in an internal memory device is executed by the microprocessor of the computer 90. Alternatively, the computer program recorded on the storage medium may be executed directly by the computer 90.

Computer 90 herein refers to a general concept including hardware devices and an operating system, and means hardware devices that operate under control of the operating system. The computer program allows the computer 90 to realize the various functions mentioned above. Some of the above functions may be realized by the operating system rather than an application program.

Computer program products include the following, by way of example.

(i) A computer-readable storage medium such as a flexible disk, optical disk, or semiconductor memory, having a computer program recorded thereon.

(ii) A data signal embodied in a carrier wave and including a computer program.

(iii) A computer equipped with computer-readable storage medium having a computer program recorded thereon, such as a flexible disk, optical disk, or semiconductor memory.

(iv) A computer having a computer program held in temporary memory, placed therein through data transfer means.

Although the present invention has been described and illustrated in detail, it is clearly understood that the same is by way of illustration and example only and is not to be taken by way of limitation, the spirit and scope of the present invention being limited only the terms of the appended claims.

What is claimed is:

1. Dot recording method for recording dots on a surface of a printing medium, using a dot recording device, the device comprising a dot recording head equipped with a plurality of nozzles for ejecting ink drops, and a platen disposed extending in a direction of a main scanning so as to face the nozzles over at least a portion of a main scanning path, for supporting a printing medium so that it faces the dot recording head, the platen further having a recessed portion disposed extending in the direction of the main scanning at a location facing at least some of the plurality of nozzles, comprising:

performing an edge portion process in which to record dots on a main scan line at a leading edge or trailing edge of the printing medium, wherein ink drops are ejected from at least a portion of a recessed portion nozzle group comprising nozzles that are situated facing the recessed portion, while at least one of the leading edge and trailing edge is positioned over an opening of the recessed portion;

and further, in the edge portion process, executing a plurality of times a first unit scan operation in which one or more main scannings are performed to record dots on a plurality of main scan lines that include two or more main scan lines adjacent to one another, and performing an edge portion process sub-scan by a first feed distance at the interval between first unit scan operations.

2. Dot recording method according to claim 1, wherein the first unit scan operation is a single main scanning.

3. Dot recording method according to claim 1, wherein the first unit scan operation includes a plurality of main scannings, and a sub-scan by a second feed distance which is smaller than the first feed distance performed at the interval between first unit scan operations.

4. Dot recording method according to claim 1, wherein the first feed distance is a feed distance such that a leading edge nozzle of the recessed portion nozzle group is positioned over a main scan line situated adjacently rearward of a main scan line at a trailing edge of a cluster of main scan lines adjacent to one another, the cluster of main scan lines having had dots recorded thereon by the recessed portion nozzle group during a proximate first unit scan operation.

5. Dot recording method according to claim 1, further comprising:

providing graphics data in which an image to be recorded on the printing medium is set to the outside of the printing medium, beyond the edge on which the edge portion process is performed, wherein in the edge portion process ink drops are ejected from at least some of the nozzles of the recessed portion nozzle group, on the basis of the graphics data.

6. Dot recording method according to claim 1, wherein in the edge portion process ink drops are ejected from only one or more of the nozzles of the recessed portion nozzle group.

7. Dot recording method according to claim 1, further comprising:

when recording dots on main scan lines in a midsectional portion of the printing medium, executing a midsectional process in which ink drops are ejected from a greater number of nozzles than in the edge portion process, when the leading edge or trailing edge is not positioned over the opening of the recessed portion, and in the midsectional process, executing a plurality of times a second unit scan operation in which dots are recorded on a plurality of main scan lines that include two or more adjacent main scan lines, and performing a midsectional process sub-scan by a third feed distance greater than the first feed distance, at the interval between second unit scan operations.

8. Dot recording method according to claim 7, wherein the second unit scan operation is a single main scanning.

9. Dot recording method according to claim 7, wherein the second unit scan operation includes a plurality of main scannings, and a sub-scan by a fourth feed distance which is smaller than the third feed distance performed at the interval between the main scannings.

10. Dot recording method according to claim 7, wherein the third feed distance is a feed distance such that a leading edge nozzle among the nozzles used for the midsectional process is positioned over a main scan line situated adjacently rearward of a main scan line at a trailing edge of a cluster of main scan lines adjacent to one another, the cluster of lines having had dots recorded thereon during a proximate second unit scan operation.

11. Dot recording method according to claim 7, wherein, in the edge portion process:

with the leading edge of the printing medium positioned over the opening of the recessed portion, executing the edge portion process; and where the leading edge of the printing medium is positioned over the opening of the recessed portion, and where, when the edge portion process sub-scan and the first unit scan operation will be performed subsequently, a main scan line at a leading edge of edge process unit lines, which are a set of main scan lines that can be recorded by the recessed portion nozzle group in the course of a single first unit scan operation, is situated rearward of a main scan line situated a predetermined distance from the leading edge of the printing medium, a sub-scan is performed, and the second unit scan operation is performed, to transition to the midsectional process.

12. Dot recording method according to claim 11, wherein the sub-scan is performed to a relative position such that a main scan line at a leading edge of a midsectional process unit band, which is a cluster of main scan lines that the nozzles used in the midsectional process can record without gaps in a direction of the sub-scan by means of a single second unit scan operation, is aligned with a main scan line situated adjacently rearward of the main scan line situated the predetermined distance from the leading edge of the printing medium.

13. Dot recording method according to claim 7, wherein, in the edge portion process:

with the leading edge of the printing medium positioned over the opening of the recessed portion, executing the edge portion process; and where the leading edge of the printing medium is positioned over the opening of the recessed portion, and where, when the edge portion process sub-scan and the first unit scan operation will be performed subsequently, a main scan line at the leading edge of edge process unit lines, which are a set of main scan lines that can be recorded by the recessed portion nozzle group in the course of a single first unit scan operation, is situated rearward of a main scan line situated a predetermined distance from the leading edge of the printing medium, the edge portion process sub-scan is performed, and the second unit scan operation is performed, to transition to the midsectional process.

14. Dot recording method according to claim 7, wherein in the edge portion process:

with the trailing edge of the printing medium positioned over the opening of the recessed portion, executing the edge portion process; and in the midsectional process, when the midsectional process sub-scan and the second unit scan operation will be performed subsequently, a main scan line at a trailing edge of a midsectional process unit band, which is a cluster of main scan lines that the nozzles used in the midsectional process can record without gaps in a direction of the sub-scan by means of a single second unit scan operation, is situated rearward from a main scan line situated a predetermined distance from the trailing edge of the printing medium, a sub-scan is performed, and the first unit scan operation is performed, to transition to the edge portion process when the trailing edge of the printing medium is situated over the recessed portion.

15. Dot recording method according to claim 14, wherein the sub-scan is performed to a relative position such that the main scan line at the trailing edge of the midsectional process unit band is aligned with the main scan line situated the predetermined distance from the trailing edge of the printing medium.

16. Dot recording device for recording dots on a surface of a printing medium, the device comprising:

a dot recording head equipped with a plurality of nozzles for ejecting ink drops;

a main scan drive unit for driving at least the dot recording head or a printing medium, to perform main scanning;

a head drive unit for driving one or more of the plurality of nozzles during main scanning, to carry out formation of dots;

a sub-scan drive unit for moving the printing medium in a direction crossing to a direction of the main scanning, at intervals between main scannings;

a platen disposed extending in the direction of the main scanning so as to face the nozzles over at least a portion of a main scanning path, for supporting the printing medium so that it faces the dot recording head, the platen having a recessed portion disposed extending in the direction of the main scanning at a location facing at least some of the plurality of nozzles; and a control unit for controlling the main scan drive unit, the head drive unit, and the sub-scan drive unit, wherein the control unit comprises an edge process unit for performing an edge portion process in which, where dots are to be recorded on a main scan line at a leading edge or trailing edge of the printing medium, the edge process unit is operable to cause at least a portion of a recessed portion nozzle group comprising nozzles situated facing the recessed portion to eject ink drops, while at least one of the leading edge and trailing edge is positioned over an opening of the recessed portion, and wherein during the edge portion process, the edge process unit executes multiple times a first unit scan operation in which one or more main scannings are performed to record dots on a plurality of main scan lines that include two or more main scan lines adjacent to one another, and performs an edge portion process sub-scan by a first feed distance at the interval between the first unit scan operations.

17. Dot recording device according to claim 16, wherein the control unit further comprises a midsectional process unit for performing a midsectional process in which, when recording dots on main scan lines in a midsectional portion of the printing medium, the midsectional process unit causes a greater number of nozzles than in the edge portion process to eject ink drops, when the leading edge or trailing edge is not positioned over the opening of the recessed portion, and wherein during the midsectional process, the midsectional process unit executes a plurality of times a second unit scan operation in which dots are recorded on a plurality of main scan lines that include two or more adjacent main scan lines, and performs a midsectional process sub-scan by a third feed distance greater than the first feed distance, at the interval between second unit scan operations.

18. Computer program product for recording dots on a surface of a printing medium using a computer connected to a dot recording device, the dot recording device comprising: a dot recording head equipped with a plurality of nozzles for ejecting ink drops; and a platen disposed extending in a direction of a main scanning so as to face the nozzles over at least a portion of a main scanning path, for supporting a printing medium so that it faces the dot recording head, the platen further having a recessed portion disposed extending in the direction of the main scanning at a location facing at least some of the plurality of nozzles, wherein the computer program product comprises:

a computer readable medium; and a computer program stored on the computer readable medium, the computer program comprising:

a first unit for causing the computer to perform an edge portion process in which to record dots on a main scan line at a leading edge or trailing edge of the printing medium, wherein ink drops are ejected from at least a portion of a recessed portion nozzle group comprising nozzles that are situated facing the recessed portion, while at least one of the leading edge and trailing edge is positioned over an opening of the recessed portion, wherein in the edge portion process, the first unit causes the computer to execute a plurality of times a first unit scan operation in which one or more main scannings are performed to record dots on a plurality of main scan lines that include two or more main scan lines adjacent to one another, and perform an edge portion process sub-scan by a first feed distance at the interval between first unit scan operations.

19. Computer program product according to claim 18, wherein the computer program further comprises:

a second unit for causing the computer, when recording dots on main scan lines in a midsectional portion of the printing medium, to execute a midsectional process in which ink drops are ejected from a greater number of nozzles than in the edge portion process, when the leading edge or trailing edge is not positioned over the opening of the recessed portion, wherein the second unit causes the computer to execute a plurality of times a second unit scan operation in which dots are recorded on a plurality of main scan lines that include two or more adjacent main scan lines, and perform a midsectional process sub-scan by a third feed distance greater than the first feed distance, at the interval between second unit scan operations.

* * * * *

UNITED STATES PATENT AND TRADEMARK OFFICE

CERTIFICATE OF CORRECTION

PATENT NO. : 6,953,237 B2
DATED : October 11, 2005
INVENTOR(S) : Koichi Otsuki

It is certified that error appears in the above-identified patent and that said Letters Patent is hereby corrected as shown below:

Title page,
Insert Item -- [30] Foreign Application Priority Data,
August 23, 2002 (JP) …….. 2002-243449 --.

Signed and Sealed this

Twenty-eighth Day of March, 2006

JON W. DUDAS
*Director of the United States Patent and Trademark Office*